US008647189B2

(12) United States Patent
Kitamura

(10) Patent No.: US 8,647,189 B2
(45) Date of Patent: Feb. 11, 2014

(54) GAMING MACHINE CAPABLE OF DISPLAYING INFORMATION FOR A DESCRIPTION OF BET TYPES INCLUDING A WINNING CONDITION

(75) Inventor: Kenta Kitamura, Koto-ku (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 76 days.

(21) Appl. No.: 12/889,985

(22) Filed: Sep. 24, 2010

(65) Prior Publication Data

US 2011/0092266 A1 Apr. 21, 2011

(30) Foreign Application Priority Data

Oct. 15, 2009 (JP) ..... 2009-238748

(51) Int. Cl.
*A63F 9/04* (2006.01)
*A63F 9/24* (2006.01)

(52) U.S. Cl.
USPC ..... 463/22; 273/146; 273/274; 463/16

(58) Field of Classification Search
USPC ..... 463/16, 22, 30, 42; 273/274, 146
See application file for complete search history.

(56) References Cited

U.S. PATENT DOCUMENTS 5,564,700 A 10/1996 Celona
5,588,650 A * 12/1996 Eman et al. ..... 273/142 B
5,823,879 A 10/1998 Goldberg et al.
6,077,162 A 6/2000 Weiss
6,312,332 B1 11/2001 Walker et al.
6,364,314 B1 * 4/2002 Canterbury ..... 273/274
6,375,568 B1 4/2002 Roffman et al.
6,656,040 B1 12/2003 Brosnan et al.
D485,583 S * 1/2004 Porto ..... D21/369
7,452,273 B2 11/2008 Amaitis et al.
7,458,891 B2 12/2008 Asher et al.
2001/0031656 A1 * 10/2001 Marshall et al. ..... 463/6
2007/0024003 A1 * 2/2007 Cacas ..... 273/274
2008/0093798 A1 * 4/2008 Yoshizawa ..... 273/146
2008/0096642 A1 * 4/2008 Yoshizawa ..... 463/22
2008/0113706 A1 * 5/2008 O'Halloran ..... 463/16
2009/0048010 A1 * 2/2009 Kroeckel et al. ..... 463/13
2009/0124348 A1 * 5/2009 Yoseloff et al. ..... 463/22
2009/0131143 A1 * 5/2009 Kelly ..... 463/19
2009/0146372 A1 * 6/2009 Witz ..... 273/146

(Continued)

FOREIGN PATENT DOCUMENTS

JP 2007130296 5/2007
WO 2005/109121 11/2005

OTHER PUBLICATIONS

Bill Burton, Try a New Slot Game, May 3, 2008, http://casinogambling.about.com/od/slots/a/slotvariety.htm.*

(Continued)

*Primary Examiner* — Dmitry Suhol
*Assistant Examiner* — Jason Yen
(74) *Attorney, Agent, or Firm* — Lexyoume IP Meister, PLLC.

(57) ABSTRACT

A game function which is capable of achieving high entertainability is provided. In a case where an instruction for selecting any of a plurality of bet types is inputted via an input device, information for description of the bet type is displayed based upon information data according to the bet type selected by the instruction.

3 Claims, 32 Drawing Sheets

(56) References Cited

U.S. PATENT DOCUMENTS

| | | | | |
|---|---|---|---|---|
| 2009/0176556 | A1* | 7/2009 | Gagner et al. | 463/25 |
| 2009/0181744 | A1* | 7/2009 | Yoshizawa | 463/16 |
| 2009/0305779 | A1* | 12/2009 | Nicely et al. | 463/30 |
| 2010/0069142 | A1* | 3/2010 | Kido | 463/22 |
| 2010/0148442 | A1* | 6/2010 | Walker et al. | 273/274 |

OTHER PUBLICATIONS

Bill Burton, Reading the Slot Help Screen, Sep. 28, 2004, http://casinogambling.about.com/cs/slots/a/slothelp.htm.*

* cited by examiner

FIG. 17

INSTRUCTION IMAGE DISPLAY DETERMINATION TABLE

| DEALER'S LEVEL | BET START INSTRUCTION IMAGE | BET COMPLETION INSTRUCTION IMAGE |
|---|---|---|
| ADVANCED | × | × |
| MIDDLE | × | ○ |
| BEGINNERS' | ○ | ○ |

FIG. 18

BET PRESENCE OR ABSENCE DETERMINATION TABLE

| STATION NO | 1 | 2 | 3 | 4 | 5 | 6 | 7 | 8 | 9 | 10 |
|---|---|---|---|---|---|---|---|---|---|---|
| BET INFORMATION | ABSENT | PRESENT | PRESENT | ABSENT | ABSENT | PRESENT | PRESENT | PRESENT | PRESENT | ABSENT |

FIG. 19

VIBRATION MODE DATA TABLE

| VIBRATION PATTERN | VIBRATION MODE | | |
|---|---|---|---|
| PATTERN 1 | SMALL VIBRATION: 5 SECONDS | LARGE VIBRATION: 5 SECONDS | FINE VIBRATION: 5 SECONDS |
| PATTERN 2 | SMALL VIBRATION: 4 SECONDS | LARGE VIBRATION: 5 SECONDS | FINE VIBRATION: 6 SECONDS |
| PATTERN 3 | SMALL VIBRATION: 6 SECONDS | LARGE VIBRATION: 4 SECONDS | FINE VIBRATION: 5 SECONDS |
| PATTERN 4 | SMALL VIBRATION: 3 SECONDS | LARGE VIBRATION: 8 SECONDS | FINE VIBRATION: 4 SECONDS |
| ⋮ | ⋮ | ⋮ | ⋮ |

FIG. 20

EFFECT TABLE

| VIBRATION MODE | SOUND TYPE |
|---|---|
| SMALL VIBRATION | SOUND 1 |
| LARGE VIBRATION | SOUND 2 |
| FINE VIBRATION | SOUND 3 |

FIG. 21

IC TAG DATA TABLE

| IDENTIFICATION DATA 1 | | IDENTIFICATION DATA 2 | |
|---|---|---|---|
| TYPE | ROLLED NUMBER | TYPE | ROLLED NUMBER |
| WHITE | 3 | BLACK | 5 |

FIG. 22

INFRARED-RAY CAMERA IMAGE PICKUP DATA TABLE

| X | Y | 181 | 182 | 183 | 184 | 185 | 186 | 187 |
|---|---|---|---|---|---|---|---|---|
| -50 | 55 | ○ | ○ | × | ○ | × | ○ | ○ |

FIG. 23

TYPE DOT PATTERN DATA TABLE

| DOT | PRESENCE OR ABSENCE OF INFRARED-RAY ABSORPTION INK | | | | | | | |
|---|---|---|---|---|---|---|---|---|
| 181 | × | ○ | × | × | ○ | ○ | × | ○ |
| 182 | × | × | ○ | × | ○ | × | ○ | ○ |
| 183 | × | × | × | ○ | × | ○ | ○ | ○ |
| COLOR | – | – | – | – | – | WHITE | BLACK | – |

FIG. 24

ROLLED-NUMBER DOT PATTERN DATA TABLE

| DOT | PRESENCE OR ABSENCE OF INFRARED-RAY ABSORPTION INK | | | | | | | | | | | | | | | |
|---|---|---|---|---|---|---|---|---|---|---|---|---|---|---|---|---|
| 184 | × | ○ | × | × | × | ○ | ○ | ○ | × | × | × | ○ | ○ | ○ | × | ○ |
| 185 | × | × | ○ | × | × | ○ | × | × | ○ | ○ | × | ○ | ○ | × | ○ | ○ |
| 186 | × | × | × | ○ | × | × | ○ | × | ○ | × | ○ | ○ | × | ○ | ○ | ○ |
| 187 | × | × | × | × | ○ | × | × | ○ | × | ○ | ○ | × | ○ | ○ | ○ | ○ |
| ROLLED NUMBER | – | – | – | – | – | – | – | 1 | 2 | – | – | 3 | 4 | 5 | 6 | – |

GAMING MACHINE CAPABLE OF DISPLAYING INFORMATION FOR A DESCRIPTION OF BET TYPES INCLUDING A WINNING CONDITION

CROSS-REFERENCE TO RELATED APPLICATIONS

This application is based upon and claims a priority from the prior Japanese patent Application No. 2009-238748 filed on Oct. 15, 2009, the entire contents of which are incorporated herein by reference.

BACKGROUND OF THE INVENTION

1. Technical Field

The present invention relates to a gaming machine which is capable of displaying a description of bet types.

2. Background Art

Conventionally, as disclosed in U.S. Pat. Nos. 5,564,700, 6,077,162, 6,375,568, and 6,312,332, each of conventional gaming machines has: a plurality of game terminals; a terminal controller provided for each game terminal and causing such each game terminal to execute a game; and a center controller for controlling each terminal controller. In addition to a base game which can be individually executed at each game terminal, these gaming machines each have a function of enabling a jackpot as a common game of each game terminal and distributing jackpot payments to a plurality of players. A configuration in which common games such as a craps game can be executed synchronously between game terminals is disposed in U.S. Pat. Nos. 6,656,040, 7,458,891, 7,452,273, and 5,823,879, and WO2005/109121. Japanese Patent Application Laid-open No. 2007-130296 discloses a configuration in which: game results for a predetermined number of times are predetermined; and effects for one set are provided while games of these game results are continuously executed in one set.

As described above, the conventional gaming machines have entertainability that a plurality of players can play one common game in addition to each player playing a base game individually. Further, the conventional gaming machines provide effects for one set while continuously executing a plurality of games in one set, thereby extending the degree of freedom for entertainability. Conventionally, in gaming machines having a plurality of game terminals, it has thus become important to improve entertainability when a common game is played at a plurality of game terminals. The present invention aims to provide a gaming machine, which has gaming functions that are capable of achieving high entertainability, and its related game control method.

SUMMARY OF THE INVENTION

In order to solve the above-described problem, the present invention provides the following configuration.

(1) A gaming machine, comprising:

a display device; an input device; a memory; and a processor, the memory storing layout data indicating a betting board including a plurality of betting areas and information data indicating information for description for a plurality of bet types according to each of the bet types;

each of the plurality of betting areas being associated with any of the plurality of bet types;

the processor being programmed to execute processing of:

(A) displaying the betting board on the display device, based upon the layout data stored in the memory; and (B) in a case where an instruction for selecting any of the plurality of bet types is inputted via the input device, displaying information for description of the bet types on the display device, based upon information data according to a bet type selected by the instruction.

Conventionally, there has been a problem that, where a common game is played by a plurality of game terminals, a beginner spares other players' feelings and hardly participates in the game, since the levels of skill in games are different depending upon players. On the other hand, there has been a problem that it is very cumbersome for well-skilled players if a trouble occurs in the progress of the game as a result of a beginner having participated in a game without understanding a rule. However, according to the configuration of (1), information for description of bet types is displayed by inputting an instruction for selecting a bet type, for example, even a beginner who does not understand what the bet type mean can readily play a game. Therefore, a beginner's hang-up on participation in a game is removed and smooth progress of a game for well-skilled players is ensured, thus making it possible to achieve a game with its high entertainment so that beginners and well-skilled players can enjoy smooth progress of the game simultaneously.

The present invention further provides the following configuration.

(2) The gaming machine of (1), wherein: the input device is a position input device which is provided on a front face of the display device, for detecting a position touched by a player and then outputting a detection signal indicating the touched position;

the memory stores the layout data, the information data, and button image data for displaying a description button according to each of a plurality of bet types; and the processor is programmed to, in the processing (A), along with displaying the betting board, display the description button on the display device, based upon the button image data stored in the memory; and in the processing (B), display information for description of the bet types on the display device, based upon information data according to a bet type of the descriptive button, upon receipt of a detection signal indicating a touched position coincident with a display position of the descriptive button from the position input device.

According to the configuration of (2), a descriptive button displayed together with a betting board is operated via a position input device, whereby a description of bet types is displayed, which is excellent in convenience and can arouse a willingness to participation in games.

The present invention further provides the following configuration.

(3) The gaming machine of (1), wherein: the memory stores plural types of information data with different contents of description, as information data indicating information for description of each bet type; and the processor is programmed to display information for description of the bet types on the display device, based upon information data according to the contents of description of a type selected by an instruction inputted via the input device from among the plural types of information data.

According to the configuration of (3), a player can select a type of the contents of description, thus enabling a player to select a description according to one's level of skill for a game. For example, where information data indicating information for a brief description of each bet type and information data indicating information for detailed description of each bet type are stored as information data indicating for description of each bet type, if a player inputs an instruction for selecting the brief description via an input device, the information for a brief description of the bet type is displayed. Alternatively, if a player inputs an instruction for selecting the detailed description via the input device, the information for detailed description of the bet type is displayed. Therefore, a player can enjoy a game while understanding a rule in accordance with the player's level of skill, which is excellent in convenience and can widely arouse willingness to participation in games from beginners to well-skilled players.

The present invention further provides the following configuration.

(4) The gaming machine of (1), wherein the memory stores arrangement image data for displaying a code as a game result; and the processor is programmed to:

(C) in a case where an instruction for selecting any of a plurality of betting areas is inputted via the input device, display on the display device a code as a game result of a player's win in a betting area selected by the instruction, based upon the arrangement image data.

In a craps game, for example, where an instruction for selecting "Any Seven" of "ONE ROLL BETS" is inputted, a player wins the game if a total (roll) of rolled numbers of two dice is 7. In this case, the code as a game result of player's winning in a betting area selected by the instruction is "7". With the configuration of (4), where the instruction for selecting "Any seven" is inputted in the craps game, the display device displays "7", so that a player can understand that the player has won the game intuitively (without considering a rule) by seeing the displayed "7" and the rolled total number "7". Therefore, even beginners can readily enjoy the game and can achieve higher entertainability. The code as a game result is not limitative thereto in particular, and can include suits (symbols), ranks (numeral values) or a combination thereof, or rolled numbers of dice and the like, for example. In the configuration of (4), an expression "displaying a code as a game result" denotes displaying the code in a manner enabling a player to recognize that the code is different from another code. That is, the expression "displaying a code as a game result" includes varying a display mode of an already displayed code as well as newly displaying a code which has not been displayed yet.

The present invention further provides the following configuration.

(5) The gaming machine of (1), wherein: the gaming machine is a gaming machine for executing craps and has an effect device;

the memory stores plural types of effect data for providing an effect by the effect device;

each of the plurality of effect data is associated with the number of times of roll continuation; and the processor is programmed to execute processing of:

(D) counting the number of times of roll continuation; and (E) providing an effect by the effect device, based upon effect data according to the counted number of times of roll continuation.

With the configuration of (5), an effect caused by an effect device (such as an image display device, a lamp, or a speaker, for example) varies according to the number of times of roll continuation, thus making it possible to gradually enhance expectation on a game result.

The present invention can provide a function of a common game which is capable of achieving high entertainability.

BRIEF DESCRIPTION OF THE DRAWINGS

FIG. 17 is a view showing an instruction image display determination table according to one embodiment of the present invention;

FIG. 18 is a view showing a bet presence or absence determination table according to one embodiment of the present invention;

FIG. 19 is a view showing a vibration mode data table according to one embodiment of the present invention;

FIG. 20 is a view showing an effect table according to one embodiment of the present invention;

FIG. 21 is a view showing an IC tag data table according to one embodiment of the present invention;

FIG. 22 is a view showing an infrared-ray camera image pickup data table according to one embodiment of the present invention;

FIG. 23 is a view showing a type dot pattern data table according to one embodiment of the present invention;

FIG. 24 is a view showing a rolled-number dot pattern data table according to one embodiment of the present invention;

DESCRIPTION OF THE EMBODIMENTS

Hereinafter, the embodiments of the present invention will be described with reference to the drawings.

Figure 1:
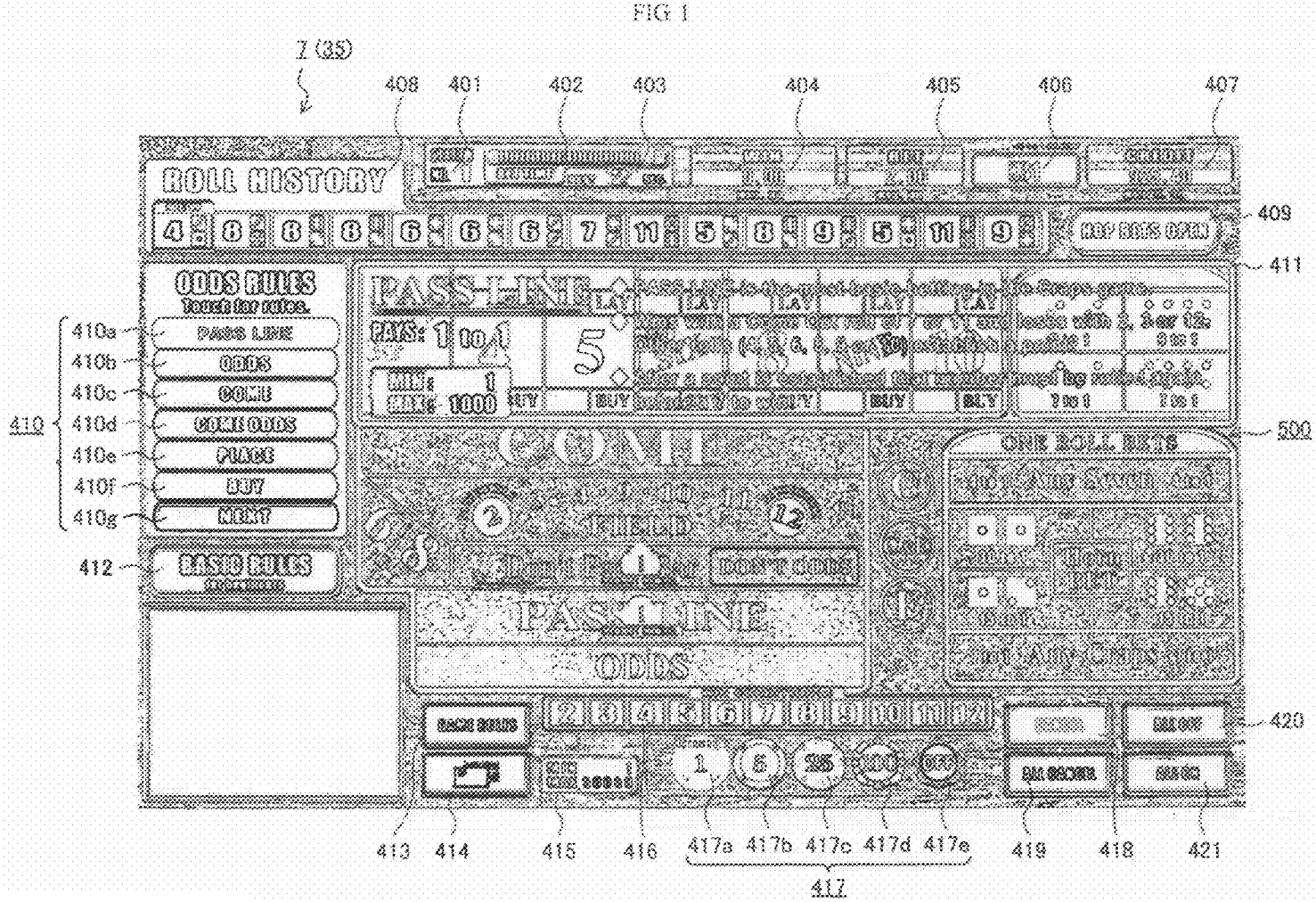
FIG. 1 is a view showing one example of a display screen according to one embodiment of the present invention.

FIG. 1 is a view showing one example of a display screen according to one embodiment of the present invention. The display screen shown in FIG. 1 is displayed on an image display device 7 of station 4 (not shown) configuring a gaming machine 1. A touch panel 35 is provided on a top face of the image display device 7, and a player touches a region in the touch panel 35 corresponding to a predetermined region of the display screen displayed on the image display device 7, thereby enabling instruction input. Hereinafter, the display screen of the image display device 7 will be described.

At the upper-most stage of the image display device 7, a station number display portion 401, a bet time gauge 402, a remaining bet time display portion 403, an acquired credit display portion 404, a bet amount display portion 405, a denomination display portion 406, and a credit display portion 407 are displayed in sequential order from the left side in the figure. The station number display portion 401 displays a unique identification number defined by station 4. The bet time display portion 402 visually displays the remaining bet time by means of the gauge. The remaining bet time display portion 403 numerically displays the remaining bet time. The acquired credit display portion 404 displays the number of credits acquired in that game. The bet amount display portion 405 displays the amount betted in that game by way of credit. The denomination display portion 406 displays a value of denomination. The credit display portion 407 displays the number of credits in station 4. Each of the display portions 401 to 407 is not set as a "button". Therefore, even if a player touches a region in the touch panel 35 corresponding to each of the display portions 401 to 407, no instruction is inputted.

At a next stage, a roll history display portion 408 and a hop bet extension button 409 are displayed sequentially from the left side. The roll history display portion 408 displays the past 15 game results (rolled numbers of dice in craps games) in a horizontal manner. Specifically, a total of rolled numbers of two dice and the rolled number of each dice are displayed as one game result. In the embodiment, the roll history display portion 408 is not set as a "button". However, in the present invention, the roll history display portion 408 may be set as a "button". For example, this display portion may be configured so that a player touches a region in a touch panel 35 corresponding to a region in which one game result is to be displayed, whereby a betting area, a bet amount, or acquired prize money and the like, which the player has betted in that game, are displayed. The hop bet extension button 409 is set as a "button", and displays a betting board for hop bet (see FIG. 28) if a player touches a region in the touch panel 35 corresponding to the hop bet extension button 409. The betting board for hop bet will be described later.

Bet type selection buttons 410 are displayed downward at the left-most side of the roll history display portion 408. As the bet type selection buttons 410, bet type selection buttons 410*a* to 410*f*, i.e., "PASS LINE", "ODDS", "COME", "COME ODDS", "PLACE", and "BUY" buttons are disposed sequentially from above, and a "NEXT" selection button 410*g* is disposed downward thereof. Each of the bet type selection buttons 410*a* to 410*f* is set as a "button". If a player touches a region in the touch panel 35 corresponding to each of the bet type selection buttons 410*a* to 410*f*, a bet type information display portion 411 indicating information for description of that bet type is disposed so as to overlap on a betting board 500. The bet type information display portion 411 shown in FIG. 1 is displayed when a player touches a region in the touch panel 35 corresponding to a bet type selection button 410*a* as "PASS LINE". The bet type information display portion 411 displays information for description of bet types. The bet type selection button 410 is equivalent to a descriptive button.

A game rule display button 412 is displayed downwardly of the bet type selection button 410. The game rule display button 412 is set as a "button". If a player touches a region in the touch panel 35 corresponding to the game rule display button 412, a game rule information portion (FIG. 25 to FIG. 27) is displayed indicating a game rule relating to the progress of a craps game in a gaming machine 1. A game rule display portion will be described later in detail.

At the lowest stage, a bet rule display button 413 and an environment selection button 414, a bet allowable amount display portion 415, a winning rolled-number information display portion 416, bet buttons 417 (417*a* to 417*e*), a cancel button 418 and an all-cancel button 419, an all-off button 420, and an all-on button 421 are displayed sequentially from the left side.

The bet rule display button 413 is set as a "button". If a player touches a region in the touch panel 35 corresponding to the bet rule display button 413, a bet type information display portion (not shown) indicating information for description of each bet type in a craps game is displayed so as to overlap on the betting board 500. Two national flags are displayed on the environment selection button 414, and one national flag partially overlaps on the other one. The environment selection button 414 indicates that environment settings of the nation of a national flag displayed forward are applied. The environment selection button 414 is set as a "button". If a player touches a region in the touch panel 35 corresponding to the environment selection button 414, the national flag displayed forward is replaced with the one displayed backward, and environment settings of the nation of a national flag newly displayed forward are applied. The bet allowable amount display portion 415 displays a minimum value and a maximum value of the bet allowable amount of credits in one game. The winning rolled-number information display portion 416 displays rolled numbers of dice of a player's winning in the current contents of bet. While, in the embodiment, the winning rolled-number information display portion 416 indicates a total of rolled numbers of two dice, the rolled number of each dice may be displayed in the present invention. As bet buttons 417, bet buttons 417*a* to 417*e*, i.e., "1", "5", "25", "100", and "OFF" buttons are displayed. The bet buttons 417*a* to 417*e* are set as "buttons". If a player touches a region in the touch panel 35 corresponding to any of the bet buttons 417*a* to 417*d*, a numeric value indicated by that bet button is set as a bet amount (number of credits) in one operation at the time of betting. For example, if a player touches a region in the touch panel 35 corresponding to the bet button 417*a*, i.e., the "1" bet button, one credit is set as a bet amount in one operation at the time of betting. Afterwards, if a player touches a region in the touch panel 35 corresponding to a betting area in the betting board 500, the bet amount in one operation is betted in that betting area. If a player touches a region in the touch panel corresponding to the bet button 417*e*, i.e., the "OFF" bet button, the bet amount in one operation of present is reset. A cancel button 418, an all-cancel button 419, an all-off button 420 and an all-on button 421 are setting as "button". If the cancel button 418 is operated, an immediately preceding bets are cancelled. If the all-cancel button 419 is operated, all cancelable bets are cancelled from among the current bets. In the gaming machine 1, operating the bet type selection button 410 displays the bet type information display portion 411 (see FIG. 1); operating the game rule display button 412 displays game rule information display portions 501 to 503 (FIG. 25 to FIG. 27); and operating the bet rule display button 413 displays a bet type information display portion (not shown). When the bet type selection button 410 is operated, the bet type information display portion 411 displays a brief description of bet types. While the game rule information display portions 501 to 503 display a description of a game rule, they also includes a description of bet types and include the more detailed description than the description of the bet type information display portion 411. When the bet rule display button 413 is operated, the bet type information display portion displays the most detailed description of bet types. As just described, the gaming machine 1 displays information for description of a bet type selected by an instruction via the touch panel 35 as an input device (position input device).

Figure 2:
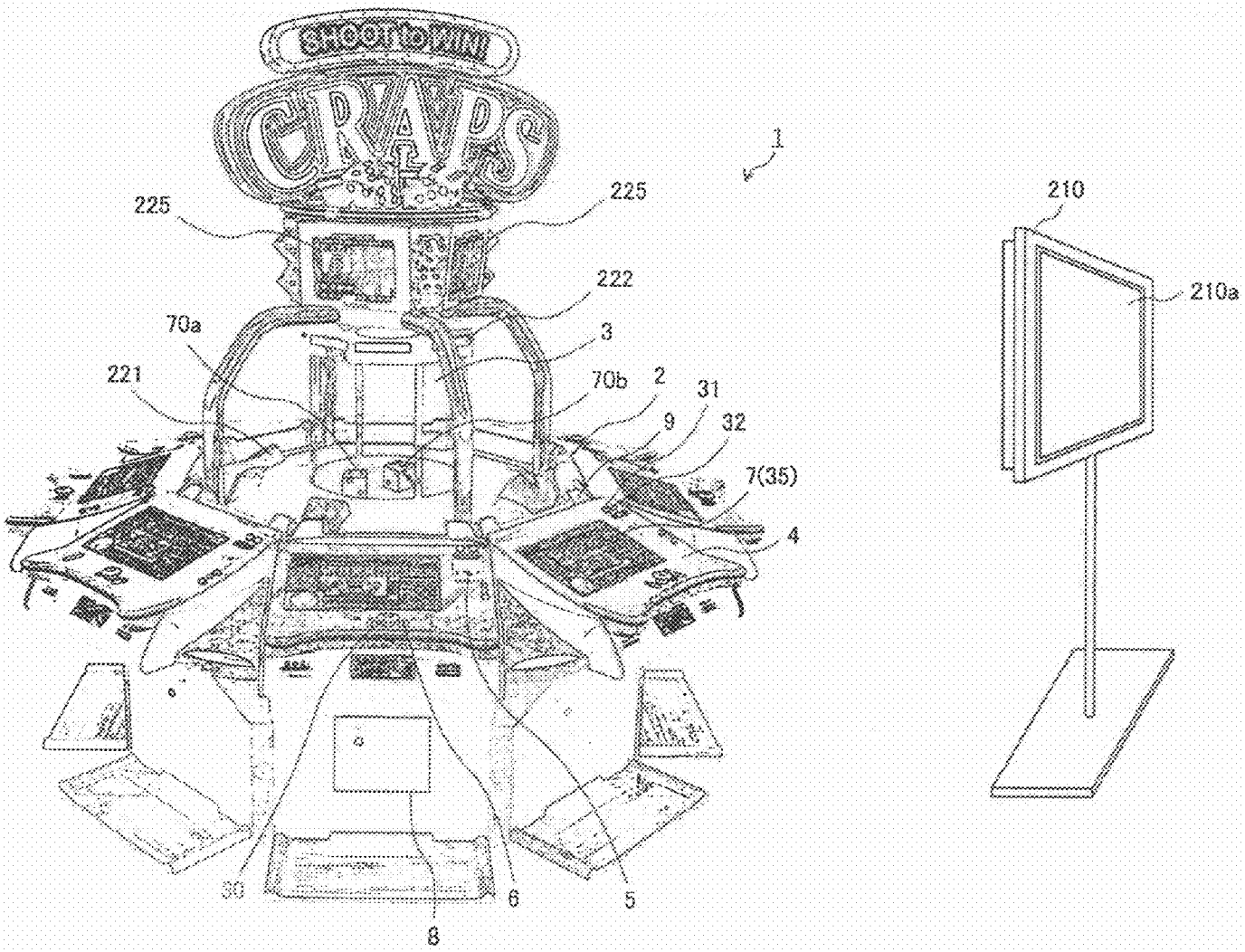
FIG. 2 is a perspective view of a game machine according to one embodiment.
Figure 3:
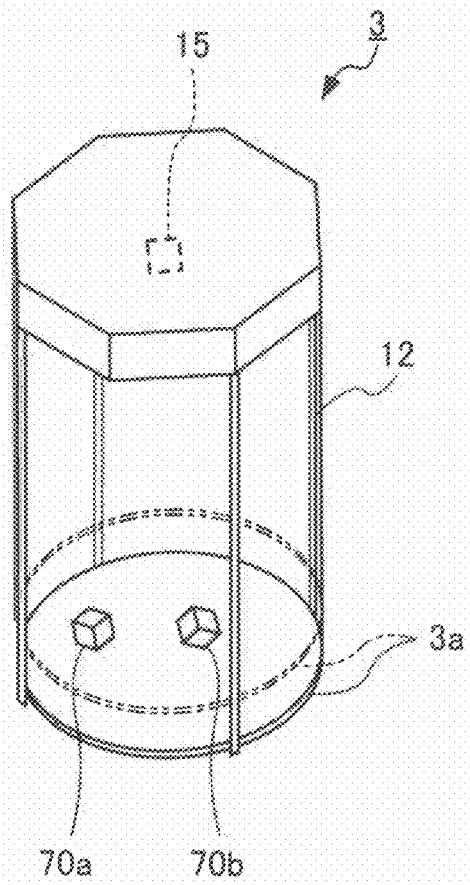
FIG. 3 is an enlarged view showing a gaming portion of the gaming machine shown in FIG. 2.

FIG. 2 is a perspective view schematically showing one example of a gaming machine according to the present invention. FIG. 3 is an enlarged view showing a gaming portion of the gaming machine shown in FIG. 2. As shown in FIG. 2, the gaming machine 1 according to the embodiment has: a cabinet 2 as a main body portion; a gaming portion 3 which is provided at a substantially central part on a top face of the cabinet 2, where a plurality of dices 70 (70*a*, 70*b*) are rolled and stopped; a plurality of stations 4 provided so as to surround the gaming portion 3; and a dealer display 210 installed so as not to be visually recognizable from a player sitting at each station 4. Each station 4 has an image display device 7. The player sitting at each station 4 participates in a game by inputting a bet while predicting rolled numbers of dice 70.

A station 4 has: a gaming medium accepting device 5 for inserting gaming media such as medals used in games; a shooter button 30 for a player to input a predetermined instruction; and an image display device 7 for displaying a screen (see FIG. 1) including a betting board or the like. A touch panel 35 is installed on a top face of the image display device 7. A player can participate in a game by operating the shooter button 30 and the touch panel 35 or the like while seeing an image displayed on the image display device 7. A shooter display lamp 6 is provided around the shooter button 30. When that station 4 is a shooter a shooter display lamp 6 lights up. Payout openings 8 are provided, respectively, at a lower front face of each station 4. Further, speakers 9 are provided on a left top and a right top of the image display device 7 of each station 4. Moreover, a payback button 31 and a help button 32 are disposed sequentially from left side, seeing form place opposed to station 4. The payback button 31 is generally a button to be depressed down after a game has completed. When the payback button 31 is depressed, gaming media according to player own credits are paid back from a payout opening 8. The help button 32 is a button for calling salesclerk in a gaming facility such as a casino. The gaming portion 3 is adapted to roll and stop a plurality of dice 70. In the embodiment, the gaming portion 3 is configured so that two dice (dice 70*a*, 70*b*) are employed. A speaker 221 and a lamp 222 are disposed around the gaming portion 3. This speaker 221 provides an effect by outputting a sound while the dice 70 roll. The lamp 222 provides an effect by emitting light while the dice 70 roll. A plurality of image display devices 225 are installed upwardly of the gaming portion 3. The image display devices 225 displays various items of information related to a craps game in progress.

As shown in FIG. 3, the gaming portion 3 has a gaming board 3*a* which is formed in a cylindrical shape and on which the dice 70 are rolled and finally stopped. An IC tag reader 16, which will be described later in FIG. 6 to FIG. 9, is provided at a lower part of the gaming board 3*a*.

The gaming board 3*a* is formed substantially horizontally, and the gaming board 3*a* vibrates in a substantially perpendicular direction relative to a substantially horizontal plane, whereby the dice 70 roll. After vibration of the gaming board 3*a* has stopped the dice 70 also stop. A CPU 81 to be described later drives a vibration motor 300, whereby the gaming board 3*a* vibrates.

Further as shown in FIG. 3, the gaming portion 3 is covered with a cylindrical transparent acrylic cover member 12, and restrains a rolling range of the dice 70. In the embodiment, an infrared-ray camera 15 for detecting rolled numbers, etc., of the dice 70 (positions of the dice 70 on the gaming board 3*a*, a type of the dice 70, or rolled numbers of the dice 0) is installed at a top of the cover member 12. Furthermore, the cover member 12 is covered with a special film (not shown) for cutting infrared rays. In this manner, when the infrared-ray camera 15 detects rolled numbers, etc. of the dice 70 applied with infrared-ray absorption ink, it is possible to prevent apprehension of incorrect detection in a case where a blinking velocity of light emitted from the periphery of the gaming portion 3 is fast, for example.

Figure 4:
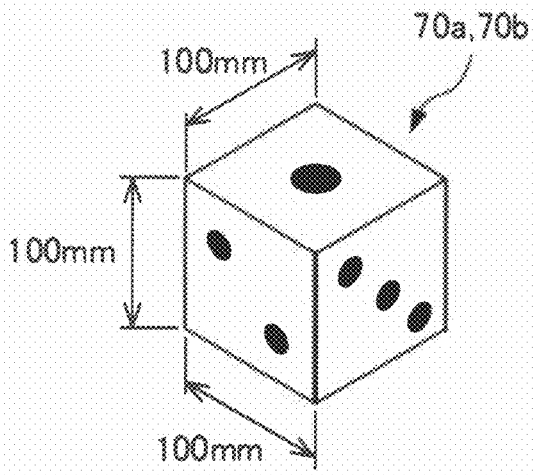
FIG. 4 is an external perspective view of dice according to one embodiment of the present invention.

FIG. 4 is an external perspective view of the dice 70. As shown in FIG. 4, each of the dice 70 is a cubic, one edge of which is 100 mm in length.

Figure 5:
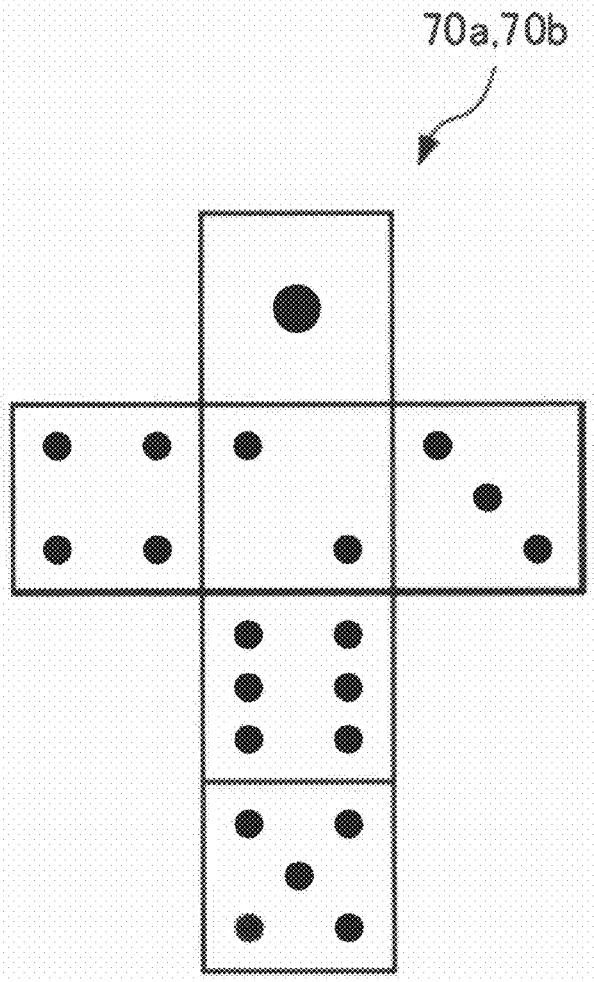
FIG. 5 is an exploded view of dice according to one embodiment of the present invention.

FIG. 5 is an exploded view of the dice 70. As shown in FIG. 5, combinations of two faces opposite to each other are "1 and 6", "2 and 5", and "3 and 4" from among six faces of each of the dice 70.

FIG. 6 to FIG. 9 are views showing a readable range of an IC tag by means of an IC tag reader 16 provided at a lower part of the gaming board 3*a*.

Now, a method of reading information stored in the IC tag by means of the IC tag reader 16 will be described.

The IC tag reader 16 is a non-contact type IC tag reader, and can read information stored in the IC tag, by means of an RFID (Radio Frequency Identification) system, for example. The RFID system is a system making short-distance communication in order to read out and write the data stored in a semiconductor memory. This technique is conventional publicly known art, and is described in Japanese Patent Application Laid-open No. 8-21875. Therefore, a description of which is omitted.

In the embodiment, one IC tag reader 16 reads a plurality of IC tags. Under the above-described RFID system, an anti-collision function of reading a plurality of IC tags by one reader can be employed. With the anti-collision function, there exist: a FIFO (First in first out) type: a multi-access type; and a selective type or the like, which are adapted to sequentially make communication with the plurality of IC tags. The FIFO type is a system of sequentially making communication with IC tags sequentially inputted in an antenna coverage area. The multi-access type is a system enabling communication with all of the IC tags even if a plurality of IC tags exists simultaneously in an antenna coverage area. The selective type is a system enabling communication with a specific tag among a plurality of IC tags existing in the system as described above. Employing the system as described above enables a plurality of IC tags to be read by means of one IC tag reader. Further, IC tag reading may be achieved by a contact-type reader without being limitative to the above non-contact type reader. IC tag reading is not limitative to the IC tag reader, and may also be appropriately set according to an object targeted to be read.

In the embodiment, the readable range of the ID tag reader 16 is 10 mm in a substantially perpendicular upper direction from an overall substantially horizontal face on the gaming board 3*a*.

Figure 6:
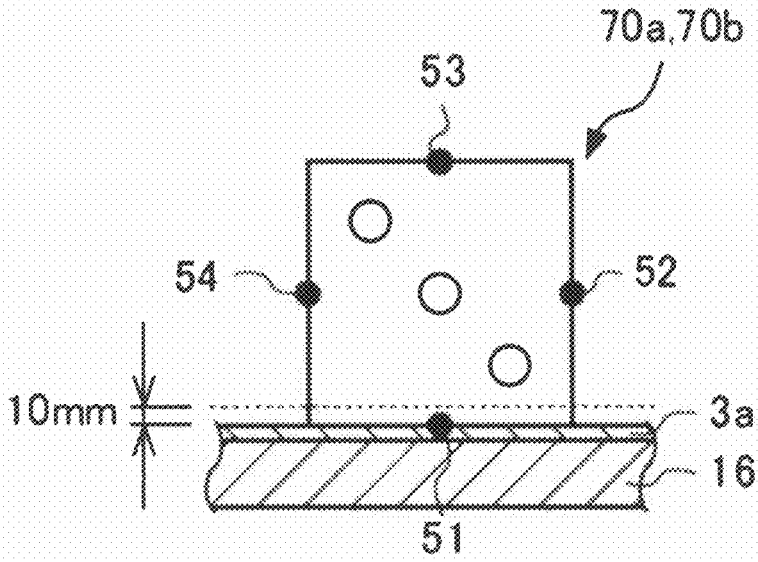
FIG. 6 is a view showing a readable range of an IC tag by means of an IC tag reader according to one embodiment of the present invention.

According to FIG. 6, one face of the dice 70 (for example, face whose rolled number is 6) is in contact with the gaming board 3*a*. Further, an IC tag is embedded in the substantially central part of each face of the dice 70 (the IC tag, faces of which are rolled numbers "3" and "4", are not shown). An IC tag 51 is embedded at a substantially central part of a face, rolled number of which is "6". An IC tag 52 is embedded in the substantially central part of a face, rolled number of which is "5". An IC tag 53 is embedded in the substantially central part of a face, rolled number of which is "1". An IC tag 54 is embedded at a substantially central part of a face, rolled number of which is "2".

The IC tag existing in the readable range of the IC tag reader 16 is only the IC tag 51. Therefore, the rolled number of a face opposite to a face in which the IC tag 51 is embedded ("1" in this case) is determined as rolled numbers of the dice 70.

Further, the rolled number of a face opposite to a face on which an IC tag is embedded is determined as rolled numbers of the dice 70; "1" is stored as rolled-number data on the IC tag 51 of a face "6"; "2" is stored as rolled-number data on an IC tag 52 of a face "5"; "6" is stored as rolled-number data on an IC tag 53 of a face "1"; "5" is stored as rolled-number data on an IC tag 54 of a face "2"; "3" is stored as rolled-number data on an IC tag (not shown) of a face "4"; and "4" is stored as rolled-number data on an IC tag (not shown) of a face "3".

Moreover, since one edge of the dice 70 is 100 mm as described above, it is physically impossible for the IC tag reader 16 to detect two IC tags as to one dice.

Figure 7:
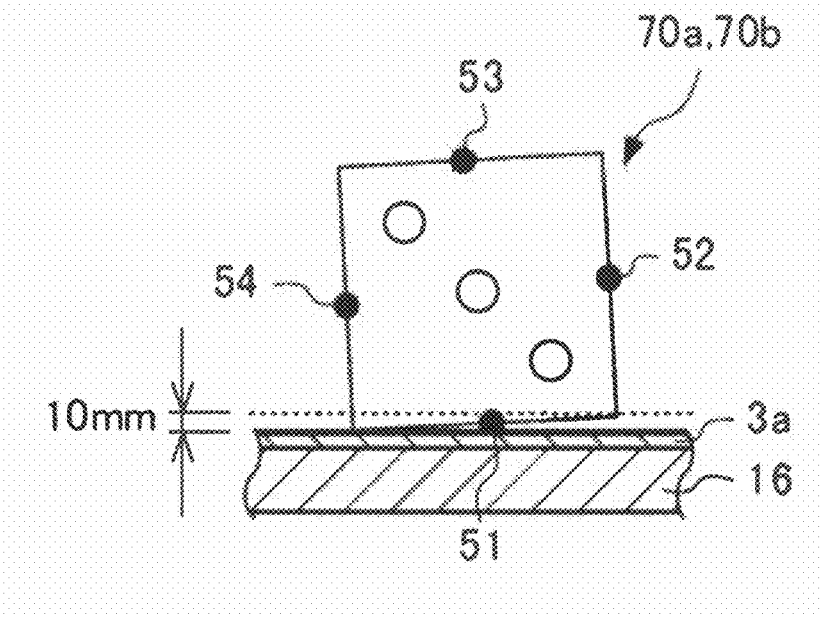
FIG. 7 is a view showing a readable range of the IC tag by means of the IC tag reader according to one embodiment of the present invention.

According to FIG. 7, the dice 70 is inclined. However, the IC tag 51 exists in the readable range of the IC tag reader 16. Therefore, even in this case, the rolled numbers of the dice 70 are determined as "1".

Figure 8:
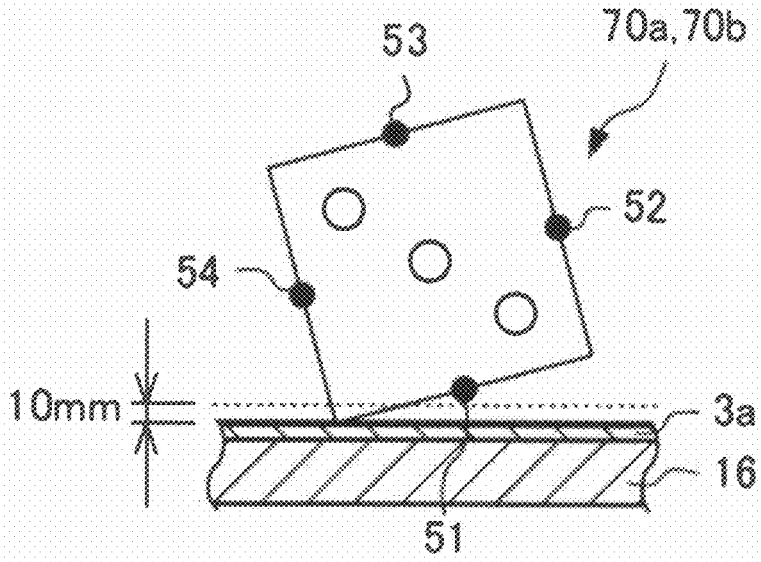
FIG. 8 is a view showing a readable range of the IC tag by means of the IC tag reader according to one embodiment of the present invention.

According to FIG. 8, the dice 70 are inclined at an angle which is greater than that in the case shown in FIG. 7. There is no IC tag in the readable range of the IC tag reader 16. Therefore, in this case, the IC tag reader 16 can detect the rolled numbers of the dice 70.

Figure 9:
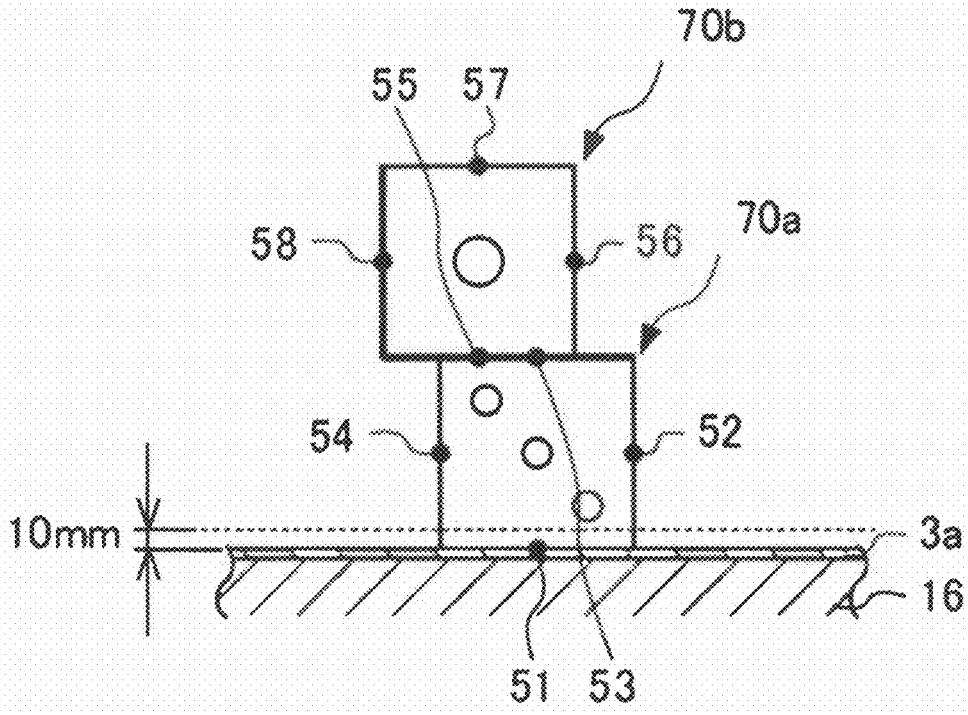
FIG. 9 is a view showing a readable range of the IC tag by means of the IC tag reader according to one embodiment of the present invention.

According to FIG. 9, the dice 70*b* overlaps on the dice 70*a*. In this case, none of the IC tags 55, 56, 57, 58 embedded in the dice 70*b* exists in the readable range of the dice 70*b*. Therefore, in this case, the IC tag reader 16 cannot detect rolled numbers of the dice 70*b*

Figure 10:
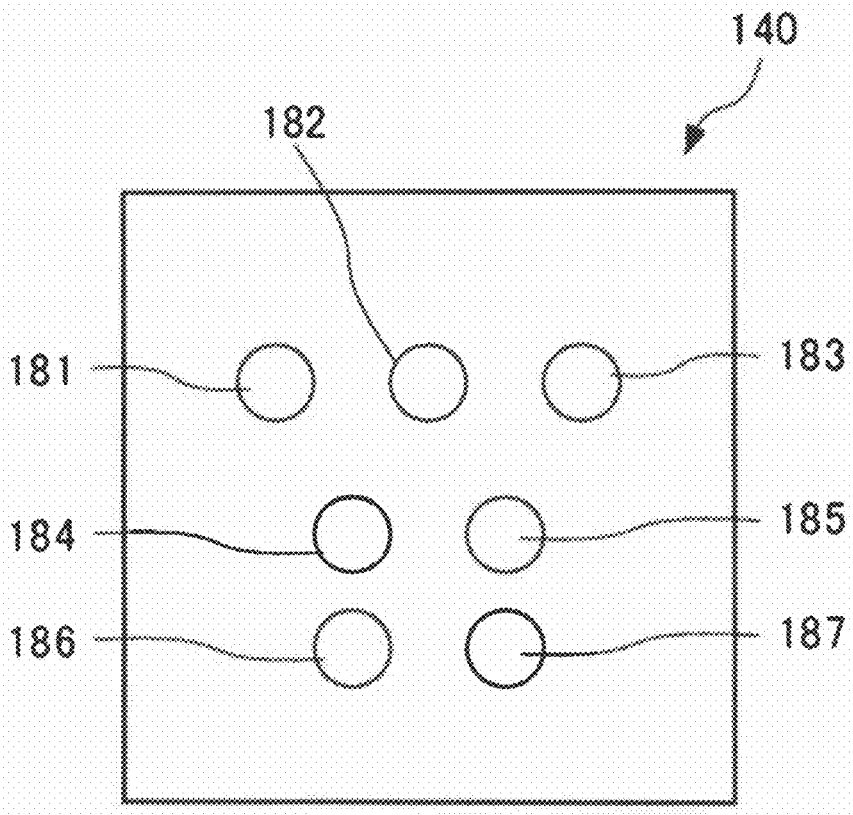
FIG. 10 is a view showing a sheet attached to each face of the dice according to one embodiment of the present invention.

FIG. 10 is a view showing a sheet 140 attached to each of the faces of the dice 70.

On each of the faces of the dice 70, the sheet 140 applied with the infrared absorption ink for identifying the rolled numbers show in FIG. 10 and types of the dice 70 is disposed so as to be covered with a sheet, rolled numbers of which are printed. According to FIG. 10, infrared-ray absorption ink can be applied to dots 181, 182, 183, 184, 185, 186, 187.

Among dots 184, 185, 186, 187, the rolled numbers of the dice 70 are identified in combination of dots to which infrared absorption ink is applied. Among dots 181, 182, 183, types of the dice 70 are identified in combination of dots to which infrared-ray ink is applied.

Figure 11:
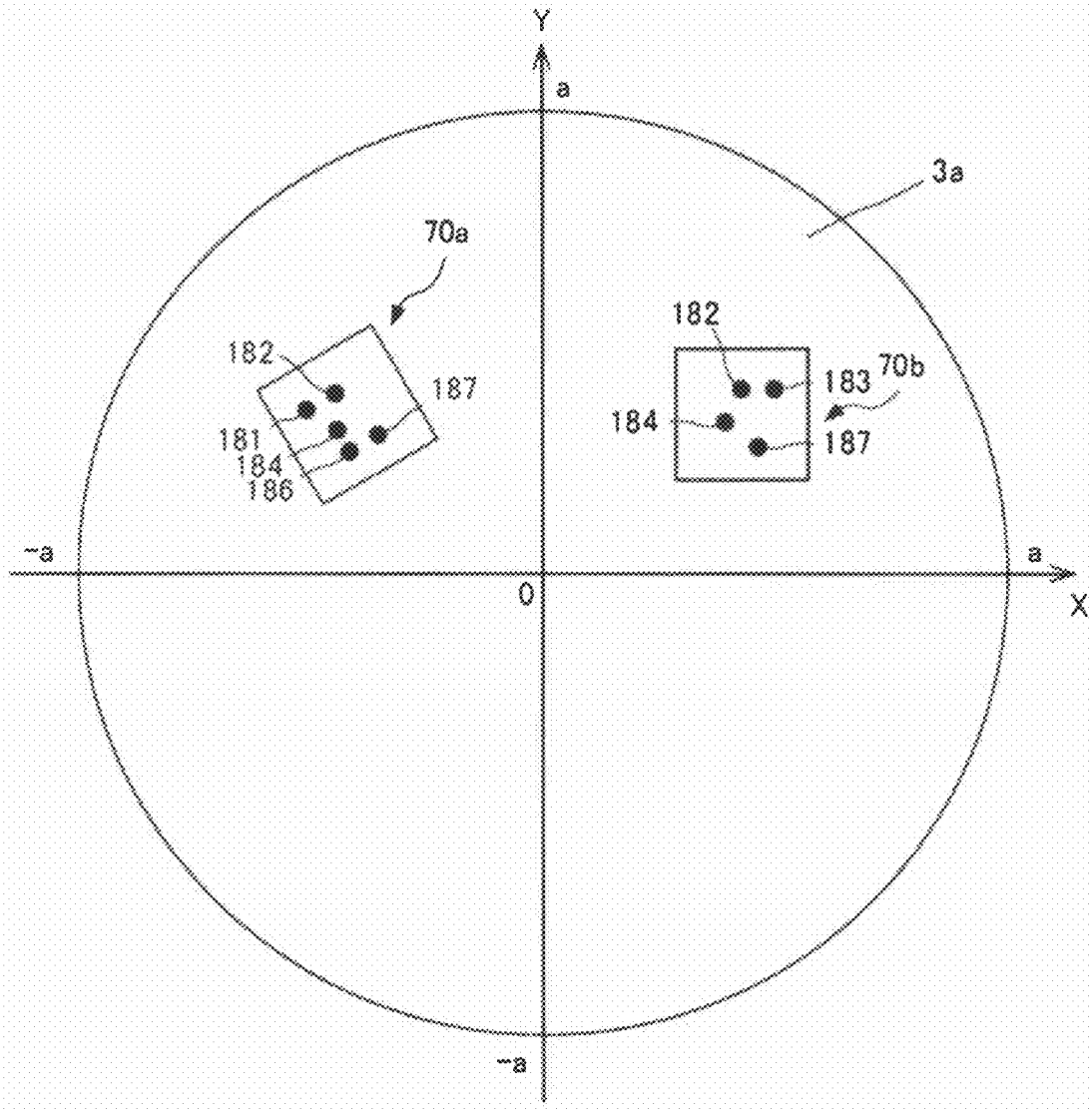
FIG. 11 is a view showing an appearance when the dice according to one embodiment of the present invention are picked up as an image from a substantially perpendicular upward position by means of an infrared-ray camera.

FIG. 11 is a view showing an appearance when the dice 70 stopped on the gaming board 3*a* is picked up as an image from the substantially perpendicular upper position by means of the infrared-ray camera 15.

According to FIG. 11, dots to which infrared-ray ink is applied is darkly picked up as an image as to a respective one of the dice 70*a*, 70*b*. The type and rolled number of a respective one of the dice 70*a*, 70*b* are determined according to a combination of the applied dots. The gaming board 3*s* is formed in a disk shape of a radius "a"; and the respective positions of the dice 70*a*, 70*b* are detected as an x-component, a y-component on the x-y coordinate.

Figure 12:
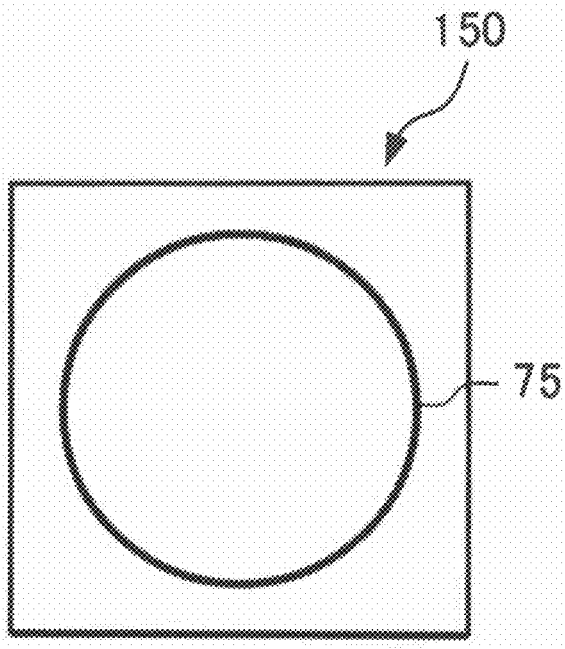
FIG. 12 is a view showing a sheet attached to each face of the dice according to one embodiment of the present invention.

FIG. 12 is a view showing a sheet 150 attached to each of the faces of the dice 70.

On each of the faces of the dice 70, as shown in FIG. 12, an outline 75 of a circle having a region of a predetermined area, which is common to each of the faces of the dice 70, is drawn by applying infrared-ray absorption ink. The sheet 150 drawn by the outline 75 of this circle is disposed so as to be covered with the above-mentioned sheet 140.

Figure 13:
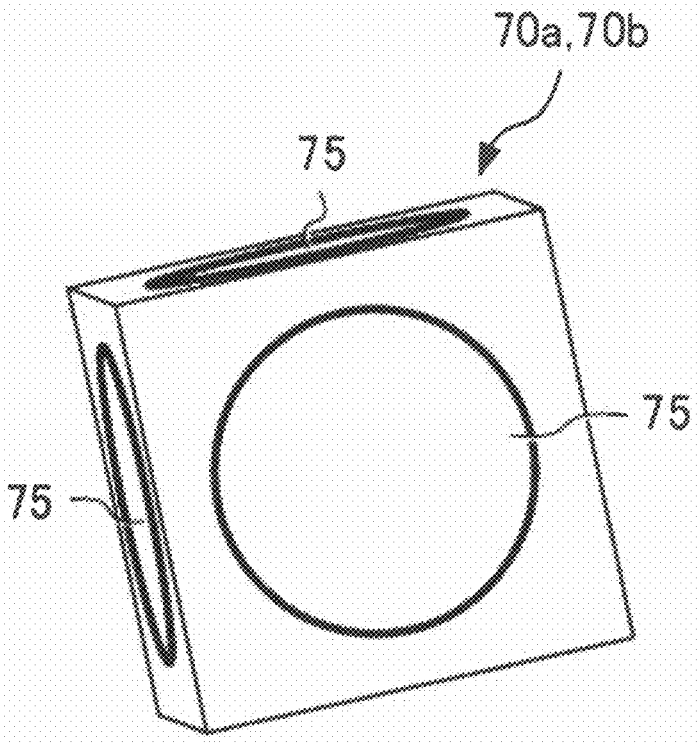
FIG. 13 is a view showing an appearance when dice having been inclined and stopped on a game board according to one embodiment of the present invention is picked up as an image from a substantially vertically upward position by means of the infrared-ray camera.

FIG. 13 is a view showing an appearance when the dice 70 inclined and stopped on the gaming board 3*a* is picked up as an image from the substantially perpendicular upward position by means of the infrared-ray camera 15.

According to FIG. 13, three faces of each of the dice 70 are picked up as images. Therefore, it must be determined as to which face's rolled number is correct. Accordingly, among these three faces, the rolled number of a face having a maximum area of square measure is determined as a correct rolled number. During this determination, the CPU in an infrared-ray camera 15 (not shown) computes an area of the outline 75 of the circle picked up as an image, and among the computed areas, determines the rolled number of a face on which the outline 75 of the circle having the maximum area.

Figure 14:
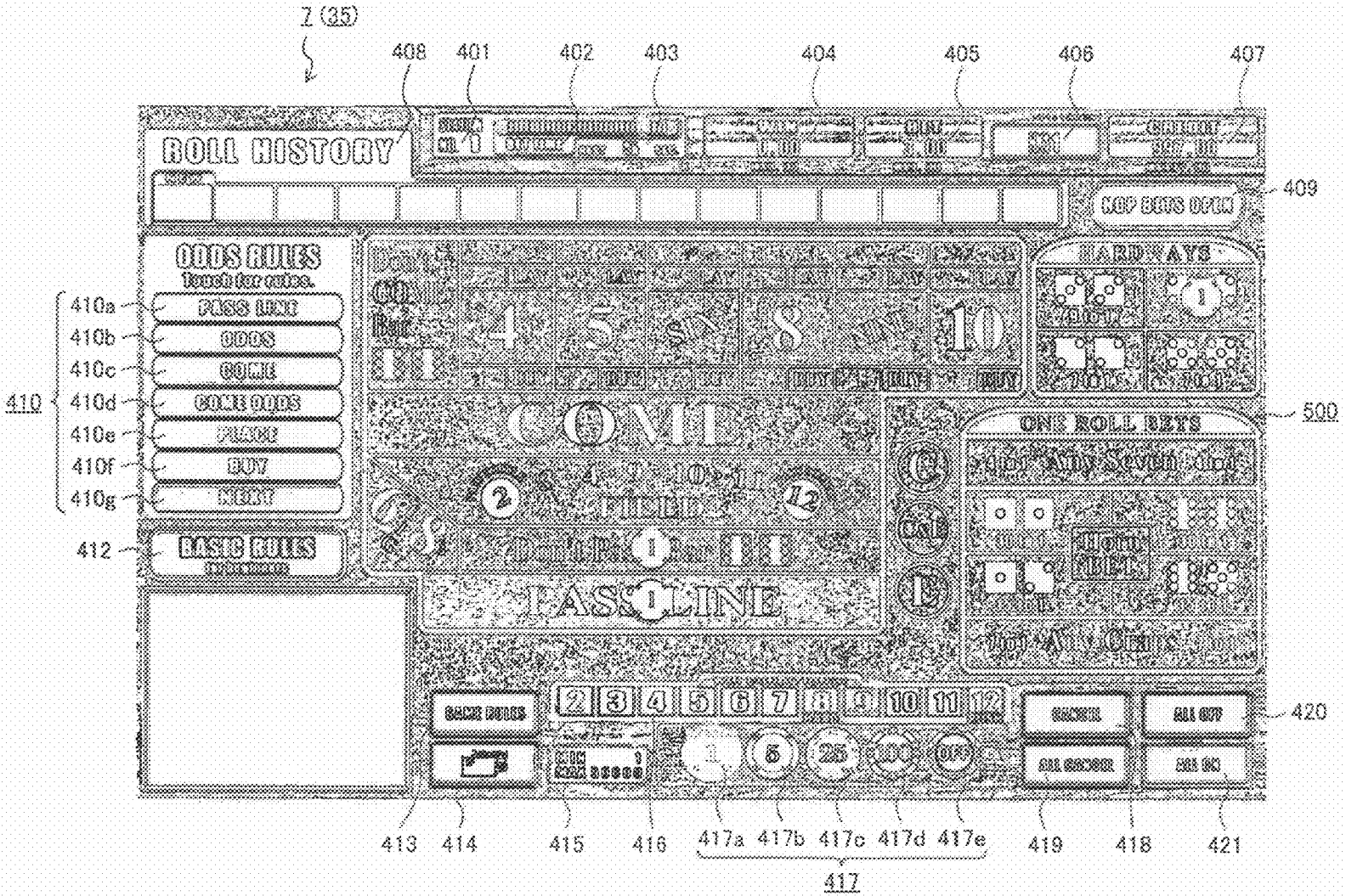
FIG. 14 is a view showing one example of a display screen according to one embodiment of the present invention.

FIG. 14 is a view showing one example of a display screen displayed on the image display device 7. The image display device 7, as shown in FIG. 14, is a liquid crystal display of a touch panel system in which a touch panel 35 is attached to a front face, and can select buttons or the like by touching the touch panel 35 with one's finger or the like. During the play of a game, with a predetermined timing the image display device 7 displays a table-type betting board (bet screen) 500 for predicting rolled numbers of the dice 70.

The betting board 500 will be specifically described. At a central part of the betting board 500, betting areas "PASS LINE", "BIG", "Don't Pass Bar", "FIELD", and "COME" are disposed sequentially from the lower side, and upward thereof, betting areas "Don't COME Bar", "4", "5", "SIX", "8", "NINE", and "10" are disposed. At "4", "5", "SIX", "8", "NINE", "10", betting areas "DON'T COME", "DON'T COME ODDS", "PLACE TO LOSE", "LAY", "COME", "COME ODDS", "PLACE", "BUY" are set (Not shown in FIG. 14. See FIG. 29.) At a right portion of the betting board 500, betting areas "C&E", "HARDWAYS", and "ONE ROLL BETS" are disposed. The conventional publicly known craps game rules are applied for the (contents) of bets in these betting areas; and therefore, a duplicate description is omitted.

A bet operation in a player is conducted within a predetermined bet time (60 seconds, for example). Specifically, a player specifies a desired betting area by touching the touch panel 35 with one's finger or the like. In this state, the player can bet chips on the betting area of the betting board 500 in units according to types of bet buttons. While, in the embodiment, bet buttons 417*a* to 417*d* are operated subsequent to selection of the betting area of the betting board 500, thereby placing a bet, the present invention is not limitative thereto. After the bet types 417*a* to 417*d* have been operated, the betting area of the betting board 500 is selected.

On the display screen shown in FIG. 14, a bet is placed on same numbers of 4 in the betting areas "PASS LINE", "Don't Pass Bar", and "HARD WAYS" by one credit, respectively. Near number "8" of the winning rolled-number information display portion 416, "HARD" is displayed, and near number "12", "PUSH" is displayed. A display "HARD" near "8" indicates that a player's win in the case where the same numbers of 4 face up, and a "PUSH" display near "12" indicates that the result is a tie in a case where the rolled numbers are 12. A "HARD" display in "8" and its vicinity is equivalent to a code as a game result when a player wins in the same numbers of 4 in "HARD WAYS". In the embodiment, numbers "1" to "12" each are a coded number as a game result and are displayed long before a player inputs an instruction. When the player then inputs an instruction for selecting a betting area, a display mode of a code as a game result of the player winning in the betting area varies.

As just described, in the embodiment, when a player places a bet, the winning rolled-number information display portion 416 displays rolled numbers of the dice (game result) of the player winning by that betting. Further, the winning rolled-number information display portion 416 displays rolled numbers of the dice (game result) drawn by that betting. In this manner, even a player who cannot determine oneself that the player is going to win which winning rolled numbers faces up, based upon a rule, can keep track of which rolled numbers face up, referring to the winning rolled-number information display portion 416. Thus, a player can see a dice rolling course of the dice in the gaming portion 3 while expecting that winning rolled numbers face up. Afterwards, the remaining time indicated by the bet time gauge 402 and the remaining bet time display portion 403 reaches 0, a bet is established.

Figure 15:
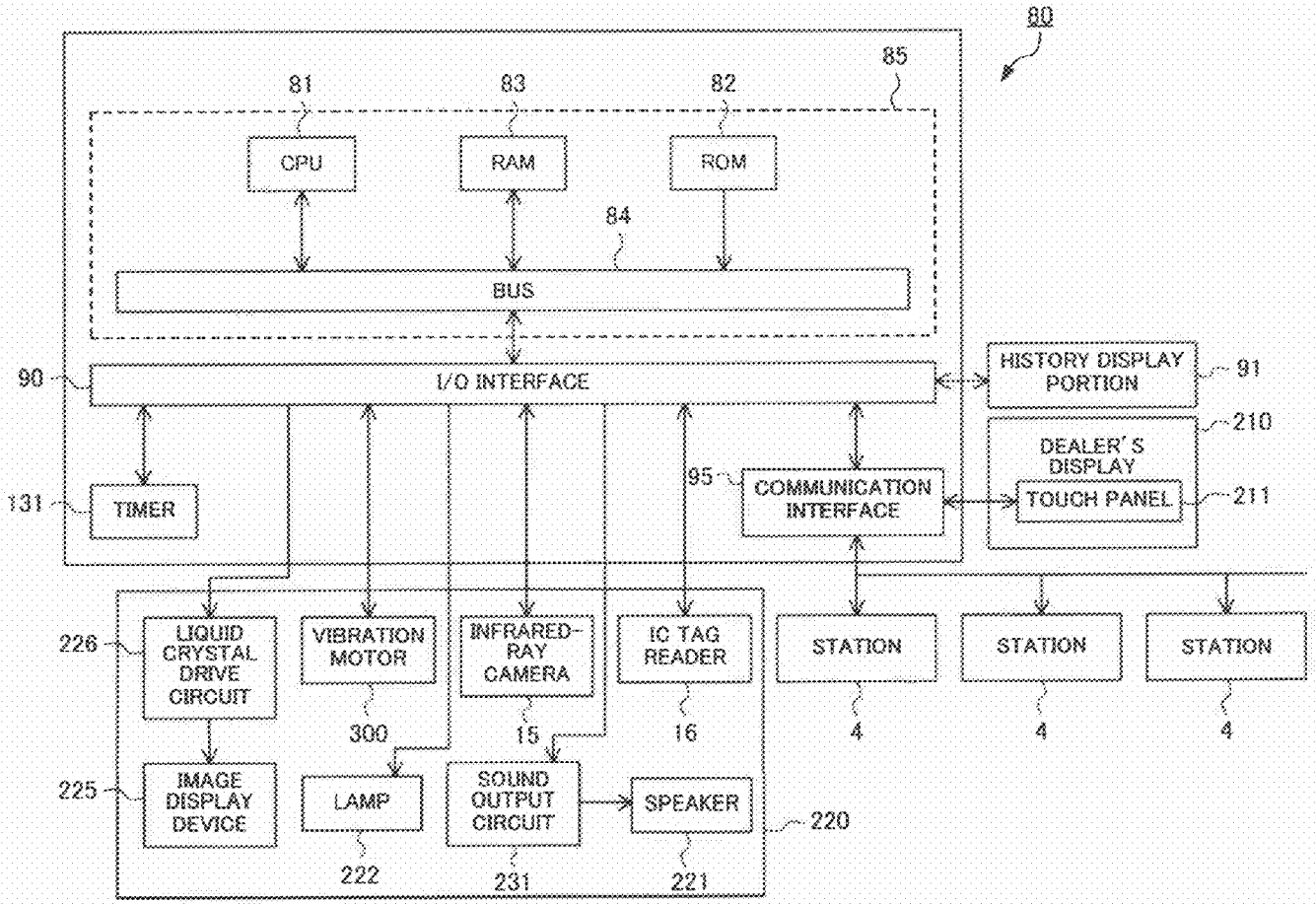
FIG. 15 is a block diagram depicting an internal configuration of a gaming machine shown in FIG. 2.

FIG. 15 is a block diagram depicting an internal configuration of the game machine shown in FIG. 2. A main control part 80 of the game machine 1 has a CPU 81, a ROM 82, a RAM 83, and a microcomputer 85 configured around a bus 84 for transferring data therebetween.

The CPU 81 is connected to a vibration motor 300 via an I/O interface 90. The CPU 81 is also connected to a lamp 222 via the I/O interface 90. A lamp 222 emits light of each color when various effects are provided based upon an output signal from the CPU 81. The CPU 81 is connected to a speaker 221 via the I/O interface 90 and a sound output circuit 231. The speaker 221 generates various effect sounds when various effects are provided based upon an output signal from the sound output circuit 231. The above-described infrared-ray camera 15 and/or IC tag reader 16 are/is connected to the I/O interface 90, and information or the like related to rolled numbers of two dices 70 stopped on the stop plate 3*a* is transmitted to or received from an infrared-ray camera 15 and/or IC tag reader 16.

The CPU 81 is connected to a timer 131 which is capable of measuring time, via the I/O interface 90. This timer 131 clocks bet time under the control of the CPU 81.

A liquid crystal drive circuit 226, an image display device 225, a vibration motor 300, an infrared-ray camera 15, an IC tag reader 16, a lamp 222, a sound output circuit 231, and a speaker 221 are included in one mechanical unit 220.

Further, a communication interface 95 is connected to the I/O interface 90. Via this communication interface 95, a main control portion 80 transmits or receives data such as a bet start signal, bet information, and payment information to or from each station 4 and transmits or receives data such as a bet start instruction image or a bet start instruction signal to or from a dealer display 210.

Moreover, a history display portion 91 is connected to the I/O interface 90, and the main control portion 80 transmits or receives data such as rolled-number information to or from the history display portion 91.

A ROM 82 in the main control portion 80 stores programs for achieving basic functions of the gaming machine 1, specifically a program controlling various kinds of devices driving the gaming portion 3 or a program or the like for controlling each station 4; and stores a payment table or the like. The ROM 82 stores an effect selection table for varying an effect in according with the number of times of rolls which end in a draw in one series of craps game. In an effect selection table, the number of times of "draw" is associated with types of effects. Specifically, the "effect of a first stage" is associated with 0 to 4 draws; the "effect of a second stage" is associated with 5 to 9 draws; and the "effect of a third stage" is associated with "10 or more" times of "draw". In addition, the ROM 82 stores programs for providing effects of the first to third stages and data employed in the programs. While the effects of the first to third stages are those due to the speaker 221, the lamp 222, and the image display device 225, these effects are different from each other.

The RAM 83 is a memory temporarily storing various items of data computed by means of the CPU 81. For example, this RAM temporarily stores: bet information transmitted from each station 4; rolled-number information of dice 70, transmitted from the infrared-ray camera 15 and/or IC tag reader 16; and data or the like related to a result of processing executed by means of the CPU 81. Specifically, the RAM 83 temporarily stores the number of times of rolls ending in a draw in single series in a craps game.

The CPU 81 controls a vibration motor 300 for vibrating a gaming portion 3, based upon data or programs stored in a ROM 82 and a RAM 83, and then, vibrates the gaming board 3*a* of the gaming portion 3. Further, after vibration of the gaming board 3*a* has stopped, the CPU 81 executes control processing associated with the progress of a game such as check processing of the rolled number or the like of each of the dice 70 stopped on the stop board 3*a*.

The CPU 81 transmits or receives data to or from each station 4 in addition to control processing associated with the progress of a game and then controls each station 4 to conduct control processing having way on the play of the game. Specifically, this CPU sets bet time, and accepts bet information transmitted from each station 4. The station 4 having transmitted bet information in bet time transmits bet information indicating that no bet is placed when bet time has elapsed. Then, the CPU conducts control of starting a game on condition that bet information is received from all of the stations 4. Further, the CPU conducts winning prize determination processing, based upon the rolled numbers of the dice 70 and the bet information transmitted from each station 4, and then, computes the amount of payment paid out in each station 4, referring to the payment table stored in the ROM 82.

Figure 16:
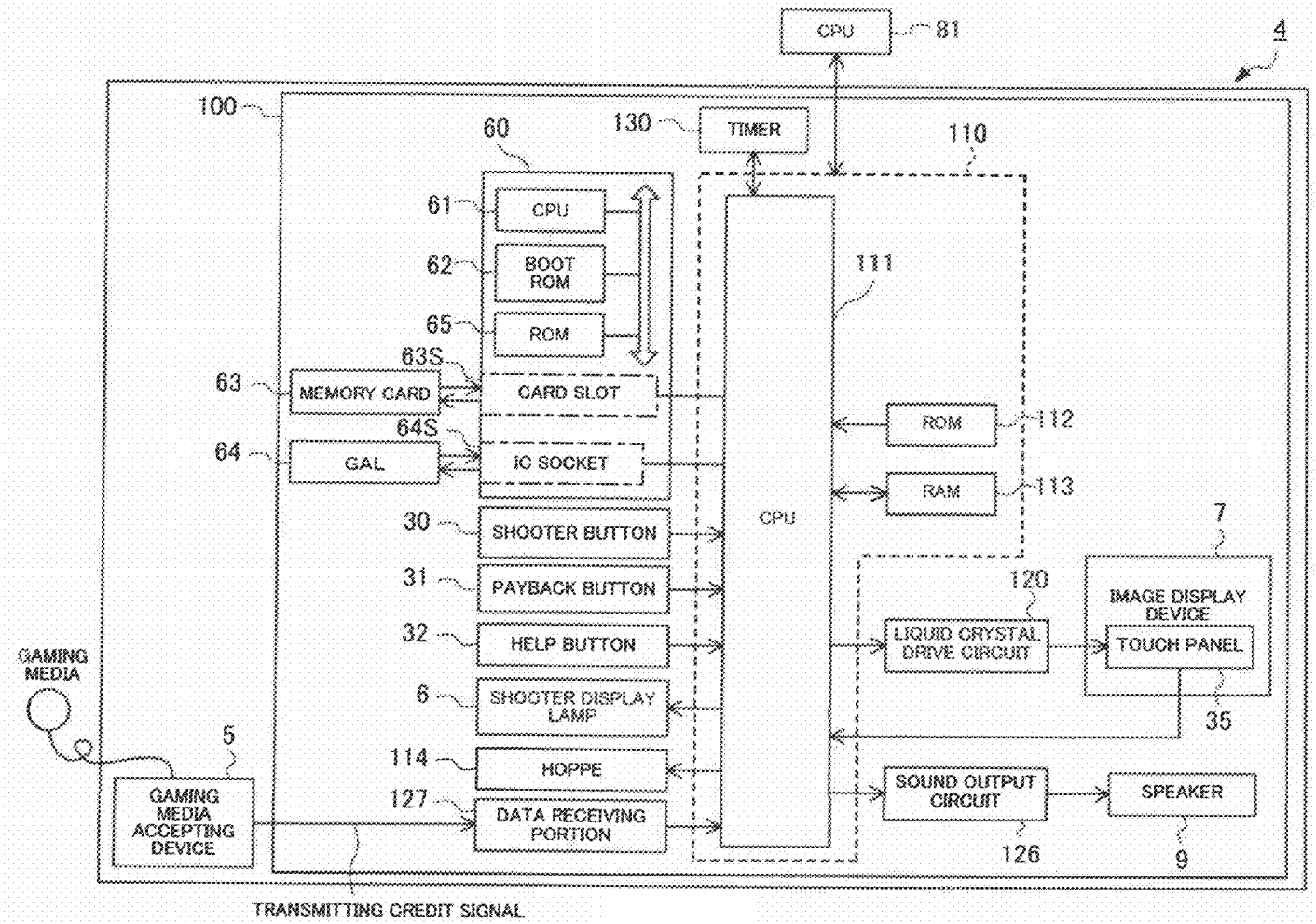
FIG. 16 is a block diagram depicting an internal configuration of a station shown in FIG. 2.

FIG. 16 is a block diagram depicting an internal configuration of the station shown in FIG. 2. The station 4 has: a main body portion 100 at which an image display device 7 or the like is provided; and a gaming medium accepting device 5 mounted to the main body portion 100. Further, the main body portion 100 has a station control portion 110 and several peripheral devices.

The station control portion 110 has a CPU 111, a ROM 112, and a RAM 113.

The ROM 112 stores programs for achieving basic functions of the station 4, various kinds of programs required for controlling the station 4, and a data table or the like.

A shooter button 30, a payback button 31, and a help button 32, respectively, are connected to the CPU 111. The CPU 111 conducts control to execute various kinds of corresponding operations, based upon an operational signal outputted by depressing each button, etc. Specifically, this CPU executes various processes, based upon input signal outputting from the shooter button 30, i.e., upon receipt of inputs operation of the player, and data or programs which are stored in the ROM 112 and the RAM 113, and then, transmits the result to a CPU 81 of a main control portion 80. A shooter display lamp 6 lights when a signal indicating that this station 4 is a shooter is received from the CPU 81 of the main control portion 80.

Further, the CPU 111 receives a command signal from the CPU 81 of the main control portion 80 and then controls peripheral devices configuring a station 4. Moreover, the CPU 111 executes various processes, based upon data or programs which are stored in the ROM 112 and the RAM 113 such as an input signal or the like supplied from the shooter button 30 or a touch panel 35. Afterwards, the CPU 111 controls peripheral devices configuring a station 4, based upon a result of the processing. By which method processing is to be conducted is set every processing in accordance with the contents of that processing. For example, payout processing of gaming media comes under the former, and the processing based upon the player's bet operation comes under the latter.

A hopper 114 is connected to the CPU 111, and the hopper 114 pays out a predetermined number of gaming media from a payout opening 8 by means of a command signal from the CPU 111.

An image display device 7 is connected to the CPU 111 via a liquid crystal drive circuit 120. The liquid crystal drive circuit 120 is comprised of: a program ROM; an image ROM, an image control CPU; a work RAM; a VDP (Video Display Processor); and a video RAM or the like. The program ROM stores: programs for image control, related to display in the image display device 7 or various kinds of selection tables. The image ROM stores dot data or the like for forming an image displayed on the image display device 7, for example. The image control CPU determines an image displayed on the image display device 7 from among the dot data stored in advance in the image ROM, based upon the parameter set by the CPU 111. The work RAM is configured as temporary storage means when the image control CPU executes an image control program. The VDP forms an image according to the contents of display determined by the image control CPU and then outputs the formed image to the image display device 7. The video RAM is configured as temporary storage means when the VDP forms an image.

A touch panel is mounted to a front face of the image display device 7, as described above, and then, operational information of the touch panel 35 is transmitted to the CPU 111. The touch panel 35 detects a player's input operation in a betting board 500 or the like. Specifically, selection of a betting area of the betting board 500 and an instruction input via a button or the like are conducted by touch operation of the touch panel 35, and the information is transmitted to the CPU 111. Afterwards, based upon the information, RAM 113 stores the player's bet information. Further, the bet information is transmitted to the CPU 81 of the main control portion 80 and then is stored in a bet information storage area of the RAM 83.

Further, a sound output circuit 126 and a speaker 9 are connected to the CPU 111 and then the speaker 9 generates various effect sounds when various effects are provided based upon an output signal from the sound output circuit 126. A gaming medium accepting device 5 which is a device for inserting gaming media such as medals or bills is connected to the CPU 111 via a data receiving portion 127. The data receiving portion 127 receives a credit signal transmitted from the gaming media accepting device 5 and then the CPU 111 increases the number of credits of a player stored in the RAM 113, based upon the transmitted credit signal.

A timer 130 capable of clocking time is connected to the CPU 111.

A gaming board 60 has: a CPU (Central Processing Unit) 61 which is interconnected by means of an internal bus; a ROM 65 and a boot ROM 62; a card slot 63S corresponding to a memory card 63; and an IC socket 64S corresponding to a GAL (Generic Array Logic) 64.

The memory card 63 is made of a nonvolatile memory such as CompactFlash (registered trademark), and stores a game program and a game system program.

A card slot 63S is configured to be able to removably insert the memory card 63, and is connected to the CPU 111 by means of an IDE bus. Therefore, the memory card 63 is removed from the card slot 63S; other game program and game system program are written into the memory card 63; and that memory card 63 is inserted into the card slot 63S, whereby types or contents of games to be played at station 4 can be changed. Types or contents of games to be played at station 4 can also be changed by exchanging a memory card 63 storing a game program and a game system program with another memory card storing other game program and game system program. Game programs include a program or the like related to the progress of a game. The game programs include image data or sound data and the like outputted during the play of a game. The memory card 63 stores layout data indicating a betting board including a plurality of betting areas. As information data indicating information for description of bet types, the memory card 63 stores: information data indicating a bet type information display portion 411 to be displayed when a bet type selection button 410 is operated; information data indicating game rule information display portions 501 to 503; and information data indicating a bet type information display portion to be displayed when a game rule display button 413 is operated. The memory card 63 includes: bet type selection buttons 410 (including 410*a* to 410*g* and further including buttons corresponding to other bet types); button image data for displaying a game rule selection button 412; and a bet rule display button 413. The bet type selection button 410 is equivalent to a description button corresponding to each of a plurality of bet types. The memory card 63 stores arrangement image data for displaying a winning rolled-number information display portion 416.

A GAL 64 is one kind of PLD having an OR-fixed arrayed structure. The GAL 64 has pluralities of input ports and output ports. When predetermined data is inputted to an input port, data corresponding to the predetermined data is outputted from an output port. An IC socket 64S is configured to be able to removably mount the GAL 64, and is connected to the CPU 111 by means of a PCI bus.

The CPU 61, the ROM 65, and the boot ROM 62 that are interconnected by means of an internal bus are connected to the CPU 111 by means of the PCI bus. The PCI bus transmits a signal between the CPU 111 and a gaming board 60 and then supplies power from the CPU 111 to the gaming board 60. The ROM 65 stores country identification information and an authentication program. The boot ROM 62 stores a preliminary authentication program and programs (boot codes) or the like for the CPU 61 to initiate the preliminary authentication program.

An authentication program is a program (tampering check program) for authenticating a game program and a game system program. The authentication program is described along authentication and certification that a game program and a game system program targeted for authentication acquisition processing are not tampered, i.e., procedures (authentication procedures) for authenticating the game program and the game system program. The preliminary authentication program is described along certification that an authentication program targeted for authentication processing is not tampered, i.e., procedures (authentication procedures) for authenticating authentication programs. The image display device 7 in the gaming machine 1 is equivalent to a display device in the present invention. The touch panel 35 is equivalent to an input device in the present invention. A computation/control device (such as a CPU 81 and a CPU 111, for example) in the gaming machine 1 is equivalent to a processor in the present invention, and storage devices (such as a memory card 63, a ROM 82, a RAM 83, a ROM 112, and RAM 113, for example) included in the gaming machine 1 is equivalent to a memory in the present invention.

With reference to FIG. 17, an instruction image display determination table will be described.

Figure 31:
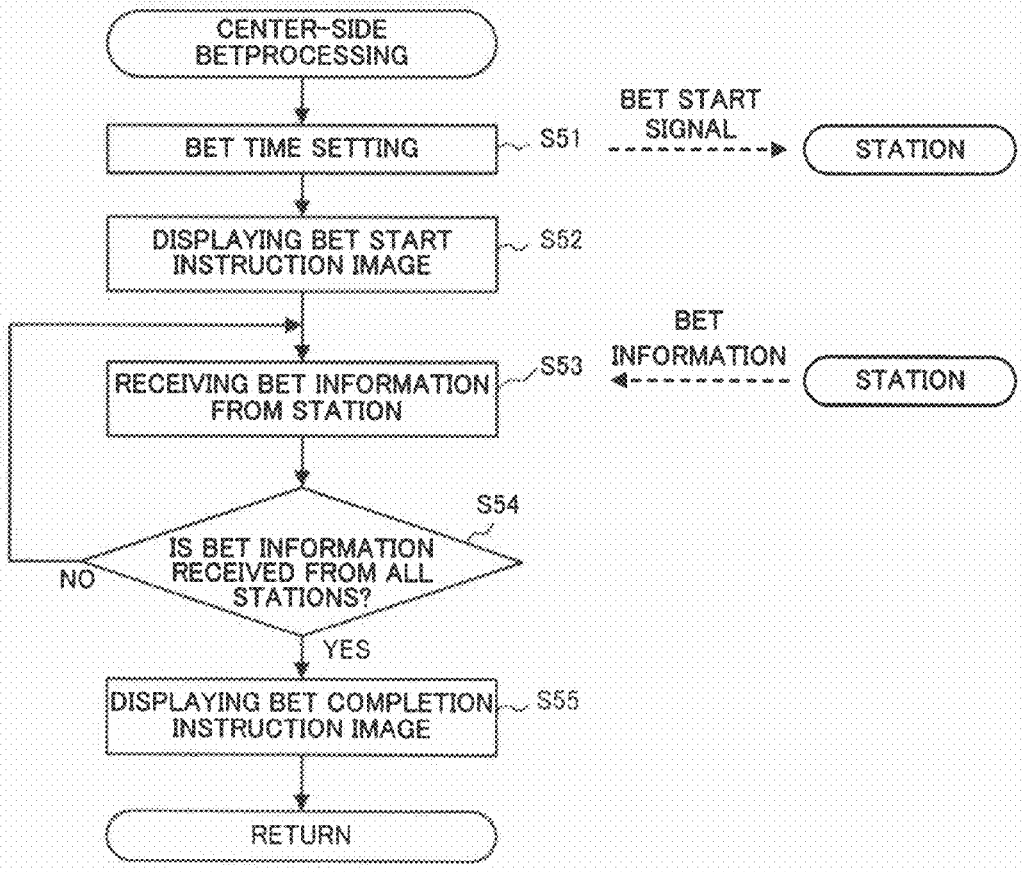
FIG. 31 is a flowchart of center-side bet processing to be executed in the game machine according to one embodiment of the present invention.

This instruction image display determination table is a table to which the CPU 81 refers when determining whether or not to display a bet start instruction image on a display screen 210*a* of a dealer's display 210 in step S52 of FIG. 31 or when determining whether or not to display a bet completion instruction image on the display screen 210*a* of the dealer's display 210.

According to this table, a mark "X" is data indicating that a bet start instruction image or the like is not displayed on the display screen 210*a*; and a mark "O" is data indicating that the bet start instruction image or the like is displayed on the display screen 210*a*. For example, in a case where the dealer's level is middle, the bet start instruction image is not displayed on the display screen 210*a*, whereas the bet completion instruction image is displayed on the display screen 210*a*. This table is stored in the ROM 82.

With reference to FIG. 18, a bet presence or absence determination table will be described.

This bet presence or absence determination table is a table which is updated where bet information is received from each station 4 in step S53 of FIG. 31 and to which the CPU 81 refers when determining whether or not bet information is received from all stations 4 in step S54 of the figure.

This table stores data indicating whether or not bet information has received by station No. A word "Present" is data indicating that bet information is received and a word "Absent" is data indicating that bet information is not received. Since this table is a table updated in each game, it is stored in the RAM 83.

With reference to FIG. 19, a vibration mode data table will be described. This vibration mode data table is a table to which the CPU 81 refers when determining combination patterns of vibration modes of the gaming board 3*a* in S3 of the routine shown in FIG. 30. This table is stored in the ROM 82.

According to this table, in the case of pattern 3, for example, the dice 70 are rolled in a duration of sequential order of 6 seconds of small vibration, 4 seconds of large vibration, and 5 seconds of fine vibration. The sequential order in degree of amplitude of the gaming board 3*a* is large vibration>small vibration>fine vibration. Vibration velocities are all equal to each other in large vibration, small vibration, and fine vibration. Further, small vibration is a vibration of level at which dice can roll; large vibration is a vibration of level at which dice greatly pop up; and fine vibration is a vibration of level eliminating an inclination of inclined and stopped dice.

With reference to FIG. 20, an effect table will be described. This effect table is a table to which the CPU 81 refers when determining effect data corresponding to a vibration mode of the gaming board 3*a* in S3 of the routine shown in FIG. 30. This effect table is stored in the ROM 82. According to this table, vibration modes and sound types correspond to each other. For example, in the case of large vibration, it is determined to be "sound 2". For example, as "sound 2", a sound just like the one indicating that dice greatly pop up is outputted from the speaker 221. Vibration modes and light emission types are associated with each other, whereby an effect according to the light emission mode corresponding to a vibration mode may be provided by lighting or blinking of the lamp 222.

With reference to FIG. 21, an IC tag data table will be described. This IC tag data table is a table representing that the CPU 81 has generated the types and rolled numbers of the respective dice as 3 from identification data 1 when an IC tag reader 16 detects the information stored in IC tags embedded in dice 70*a*, 70*b*.

According to this table, for example, where the IC tag reader 16 detects an IC tag embedded in each one of dice in sequential order of dice 70*a*, 70*b*, the type and rolled number of die 70*a* is "white" and "3" as identification data 1; and the type and rolled number of die 70*b* is "black" and "5" as identification data 2.

Where two dice cannot be detected, for example, where only one dice cannot be detected, only identification data 1 is generated as identification data. This data table is transmitted from the IC tag reader 16 to the CPU 81 and then the CPU 81 receives the transmitted data table and analyzes rolled numbers or the like.

With reference to FIG. 22, an infrared-ray camera image pickup data table will be described.

This infrared-ray camera image pickup data table is a data table indicating dot patterns of infrared-ray absorption ink applied to dice 70 and positional data on the gaming board 3*a* of dice 70, which the infrared-ray camera 15 has picked up as image.

For example, with respect to the dice 70*a* shown in FIG. 11, a CPU (not shown) in the infrared-ray camera 15 stores X=−50, Y=55 as positional data in the infrared-ray camera image pickup data table. In addition, since infrared-ray absorption ink is applied to dots 181, 182, 184, 186, 187, marks "O" are stored in 181, 182, 184, 186, 187, and since infrared-ray absorption ink is not applied to dot 183, 185, marks "X" are stored in 183, 185. This also applies to dice 70*b*.

As shown in FIG. 13, where a plurality of faces of dice 70 is picked up as an image, rolled numbers cannot be uniquely specified. Therefore, in this case, a CPU (not shown) in the infrared-ray camera 15 computes an area of a outline 75 of the plurality of faces picked up as the image and then generates the infrared-ray camera image pickup data table, based upon a dot pattern of a face having its maximum area.

Even where dice 70 is thereby inclined and stopped and then a plurality of faces of dice 70 are picked up as an image, rolled numbers can be uniquely specified. This data table is transmitted from the infrared-ray camera 15 to the CPU 81 and then the CPU 81 receives the transmitted data table and analyzes rolled numbers or the like.

With reference to FIG. 23, a type dot pattern data table will be described. According to this table, colors as types of dice 70 are determined in accordance with a combination of dots to which infrared-ray absorption ink is applied, among dots 181 to 183 described above in FIG. 10. A mark "O" indicates that infrared-ray absorption ink is applied to dots and a mark "X" indicates that infrared-ray absorption ink is not applied to dots.

For example, where the infrared-ray camera image pickup data table described in FIG. 22 is transmitted from the infrared-ray camera 15 to the CPU 81, the CPU 81 compares the received infrared-ray camera image pickup data table with the type dot pattern data table and then determines a type of dice 70 as "white".

With reference to FIG. 24, a rolled-number dot pattern data table will be described. According to this table, numbers are defined as rolled numbers of dice 70 in accordance with a combination of dots to which infrared-ray absorption ink is applied, among dots 184 to 187 described above in FIG. 10. A mark "O" indicates that infrared-ray absorption ink is applied to dots and a mark "X" indicates that infrared-ray absorption ink is not applied to dots.

For example, where the infrared-ray camera image pickup data table described in FIG. 22 is transmitted from the infrared-ray camera 15 to the CPU 81, the CPU 81 compares the received infrared-ray camera image pickup data table with the type dot pattern data table, rolled numbers of dice 70 are determined as "5".

FIG. 25 to FIG. 29 are views showing one example of a display screen according to one embodiment of this invention. In FIG. 25 to FIG. 29, like constituent elements of FIG. 1 and FIG. 14 are designated by like reference numerals.

Figure 25:
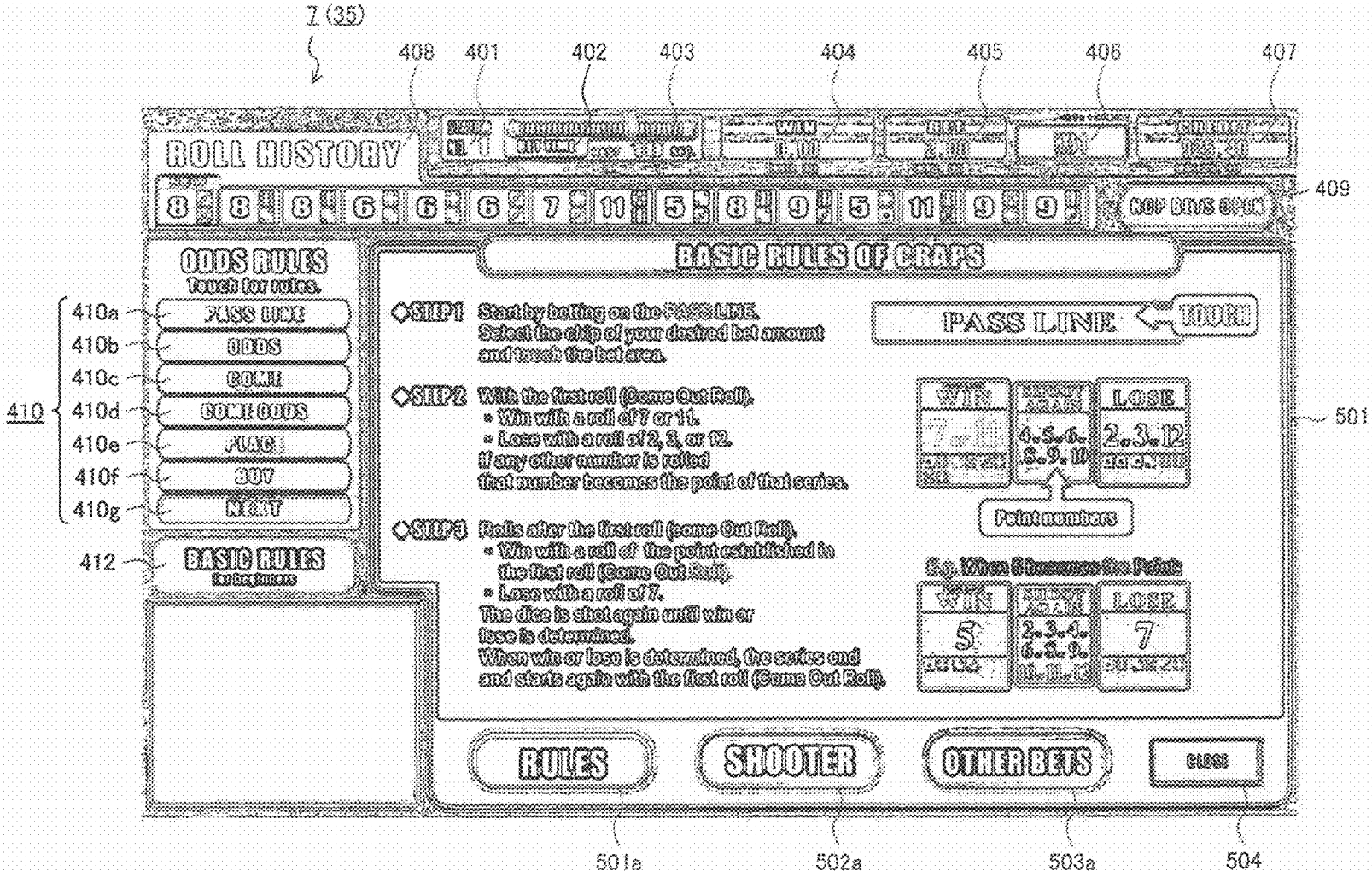
FIG. 25 is a view showing one example of a display screen according to one embodiment.

A display screen shown in FIG. 25 is a screen to be displayed when operating a game rule button 412 on the display screen shown in FIG. 14. The display screen shown in FIG. 25 displays a game rule information display portion 501 in a region in which the display screen shown in FIG. 14 displays a betting board 500. The game rule information display portion 501 displays the contents of "BASIC RULES OF CRAPS" to be divided into "STEP 1", "STEP 2", and "STEP 3". In "STEP 1", a method of betting on pass line is shown; in "STEP 2", a method of determining win or loss in a come-out roll; and in "STEP 3", a method of determining a win or a loss in roll subsequent to the come-out roll is shown. A "RULES" button 501*a*, a "SHOOTER" button 502*a*, an "OTHER BETS" 503*a*, and a "CLOSE" button 504 are disposed at the lower part of the game rule information display portion 501.

Figure 26:
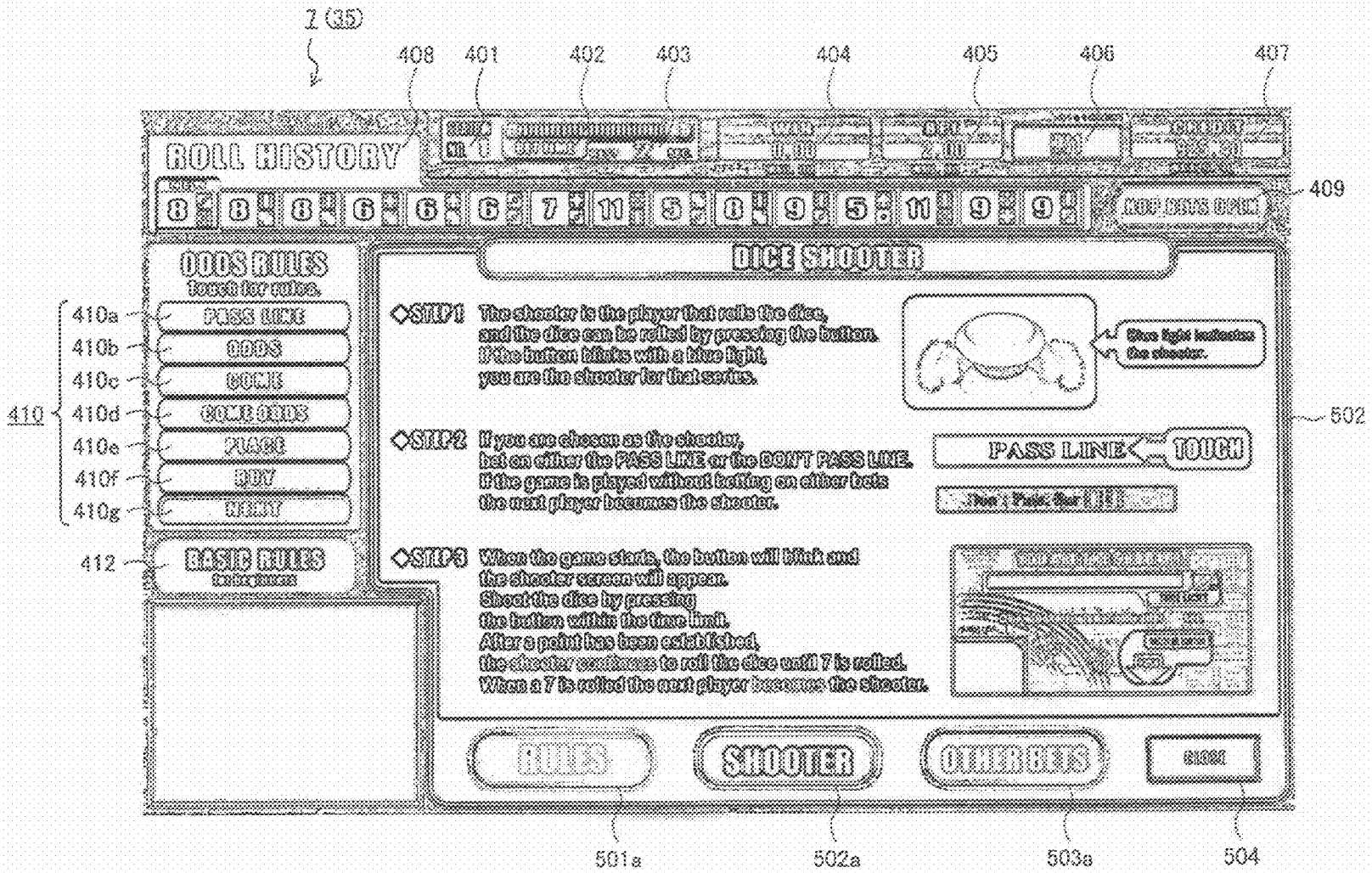
FIG. 26 is a view showing one example of the display screen according to one embodiment.

The display screen shown in FIG. 26 is a screen to be displayed when the "SHOOTER" button 502*a* is operated. The display screen shown in FIG. 26 displays a game rule information display portion 502 in a region in which the display screen shown in FIG. 14 displays a betting board 500. The game rule information display portion 502 displays the contents of "DICE SHOOTER" to be divided into "STEP 1", "STEP 2", and "STEP 3". In "STEP 1", a shooter is shown; in "STEP 2", a shooter betting is shown; and in "STEP 3", a shooter's game course is shown.

Figure 27:
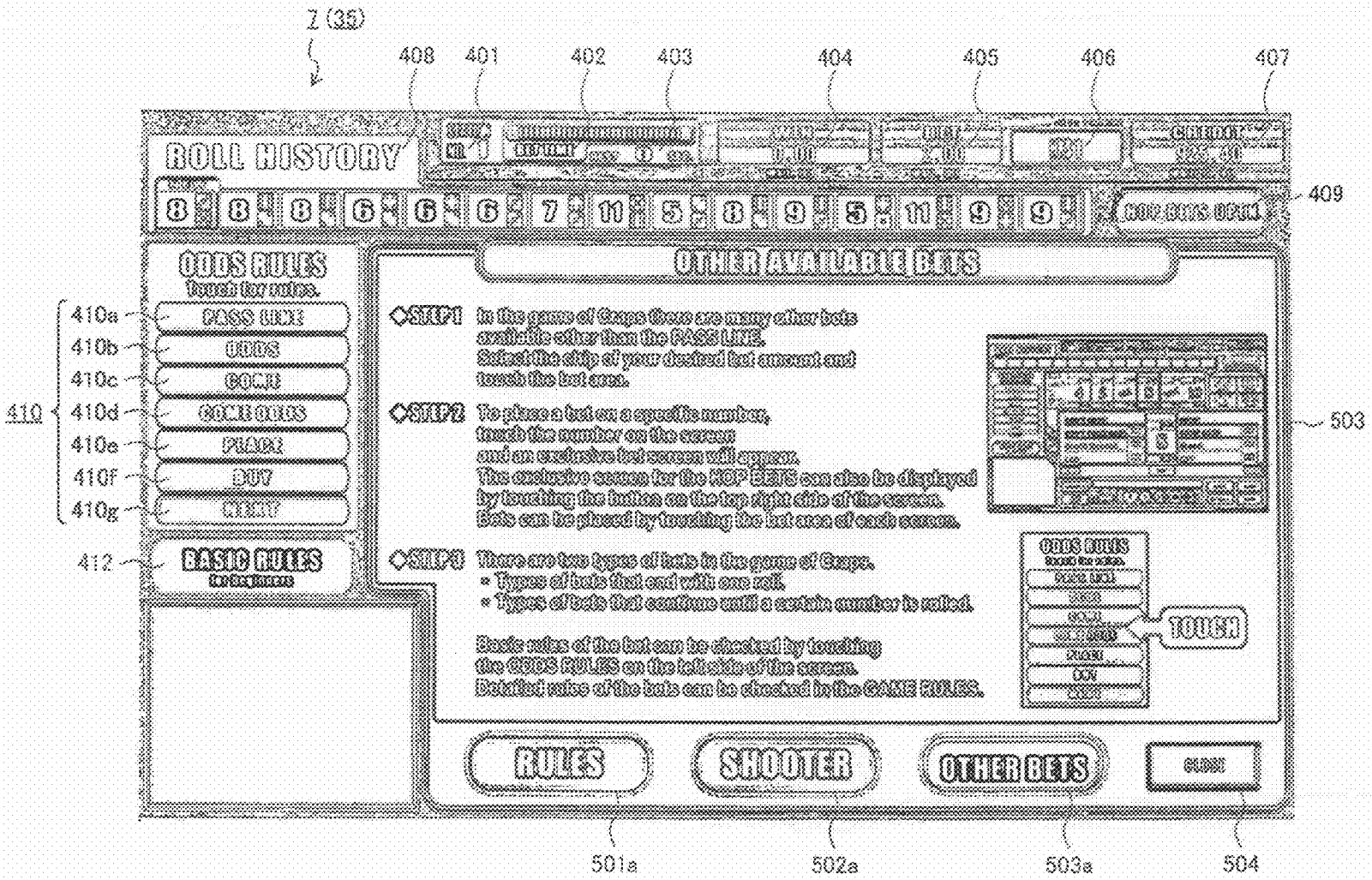
FIG. 27 is a view showing one example of the display screen according to one embodiment.

The display screen shown in FIG. 27 is a screen to be displayed when an "OTHER BETS" button 503*a* is operated. The display screen shown in FIG. 27 displays a game rule information display portion 503 in a region in which the display screen shown in FIG. 14 displays a betting board 500. The game rule information display portion 503 displays "STEP 1", "STEP 2", and "STEP 3", separately. In "STEP 1", an introduction to a bet type other than PASS LINE is shown; in "STEP 2", a description of HOP BETS is shown; and in "STEP 3", an introduction to types of craps games is shown. Further, it is shown that the game rule information display portion 503 displays a brief description of bet types by operating a bet type selection button 410 and displays a detailed description of bet types by operating a bet rule display button 413 (see FIG. 1 and FIG. 14). That is, the gaming machine 1 is configured so that the image display device 7 of station 4 can display a brief description of bet types and a detailed description of bet types. A description of game rules and a detailed description of bet types are displayed by displaying a different region of the touch panel 35.

Figure 28:
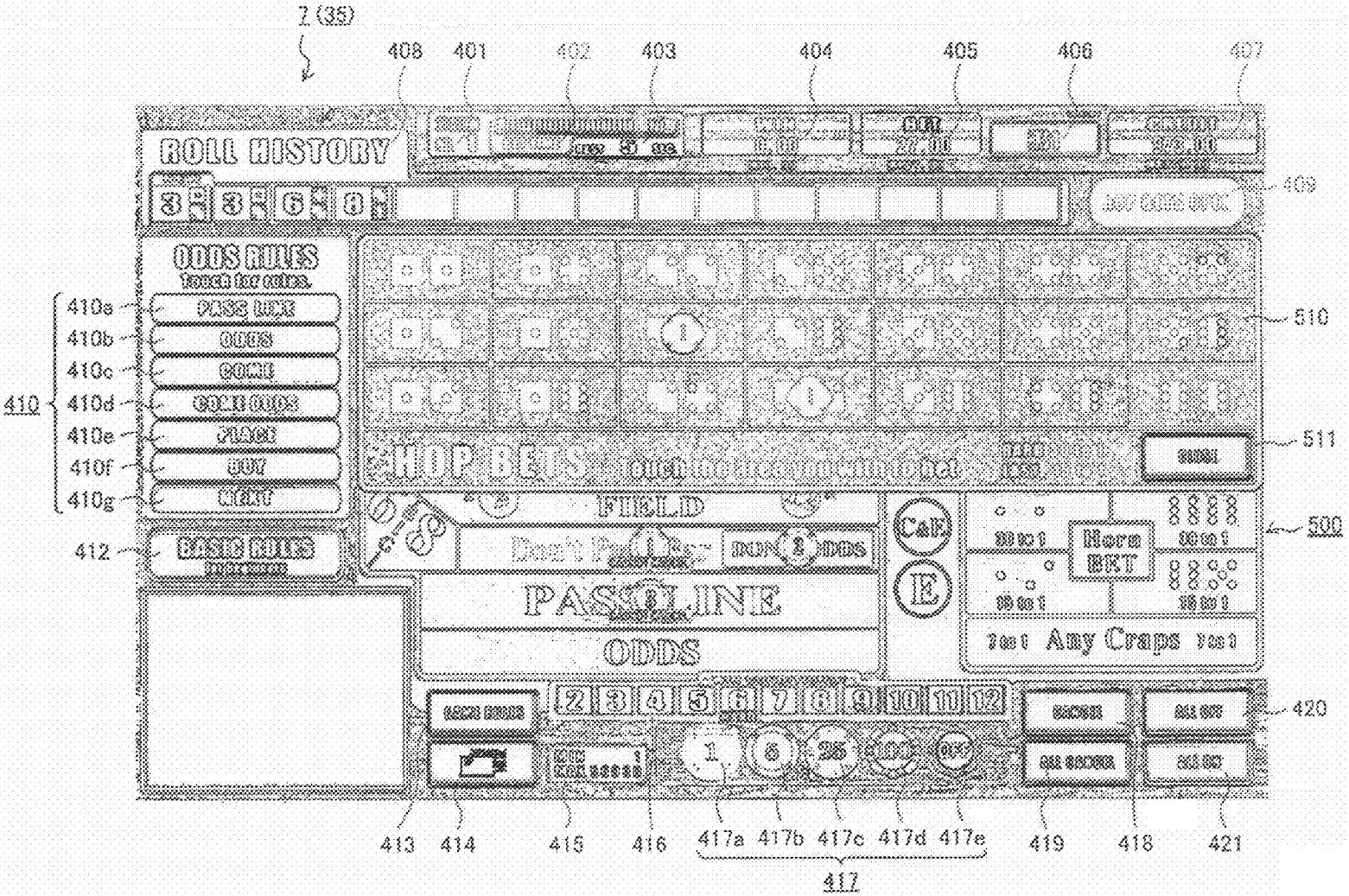
FIG. 28 is a view showing one example of the display screen according to one embodiment.

The display screen shown in FIG. 28 is a screen to be displayed when a hop bet extension button 409 is operated. The display screen shown in FIG. 28 displays a betting board 51 for hop bet in a region in which the display screen shown in FIG. 14 displays a betting board 500. In the betting board 510 for hop bet, betting areas corresponding to all of the combinations of rolled numbers of two dice are set. Specifically, 21 betting areas of "1-1", "1-2", "1-3", "1-4", "1-5", "1-6", "2-2", "2-3", "2-4" "2-5", "2-6", "3-3", "3-4", "3-5", "3-6", "4-4", "4-5", "4-6", "5-5", "5-6", and "6-6" are set. Among "HOP BET" betting areas, betting areas of "2-2", "3-3", "4-4", and "5-5" have the same rolled numbers as those of "HARDWAYS". However, "HARDWAYS" is a bet type of a player's win when a hard way (same rolled numbers) is established before an easy way (other than same rolled numbers) is established, whereas "HOP BET" is a bet type of a player's win (one-roll bet) when a bet combination of rolled numbers of two dice coincides with that of rolled numbers of two dice in roll immediately after betting. Among "HOP BET" betting areas, the "1-1", "1-2", "5-6", and "6-6" betting areas have the same rolled numbers as those of "Horn BET" in "ONE ROLL BETS", and the bet contents and payout are also similar. That is, the gaming machine 1 is configured to be able to bet on all of the combinations of rolled numbers of two dice as one-roll bets in a craps game. A craps game betting board and a betting board which is capable of betting on all of the combinations of rolled numbers of two dice are set separately.

Figure 29:
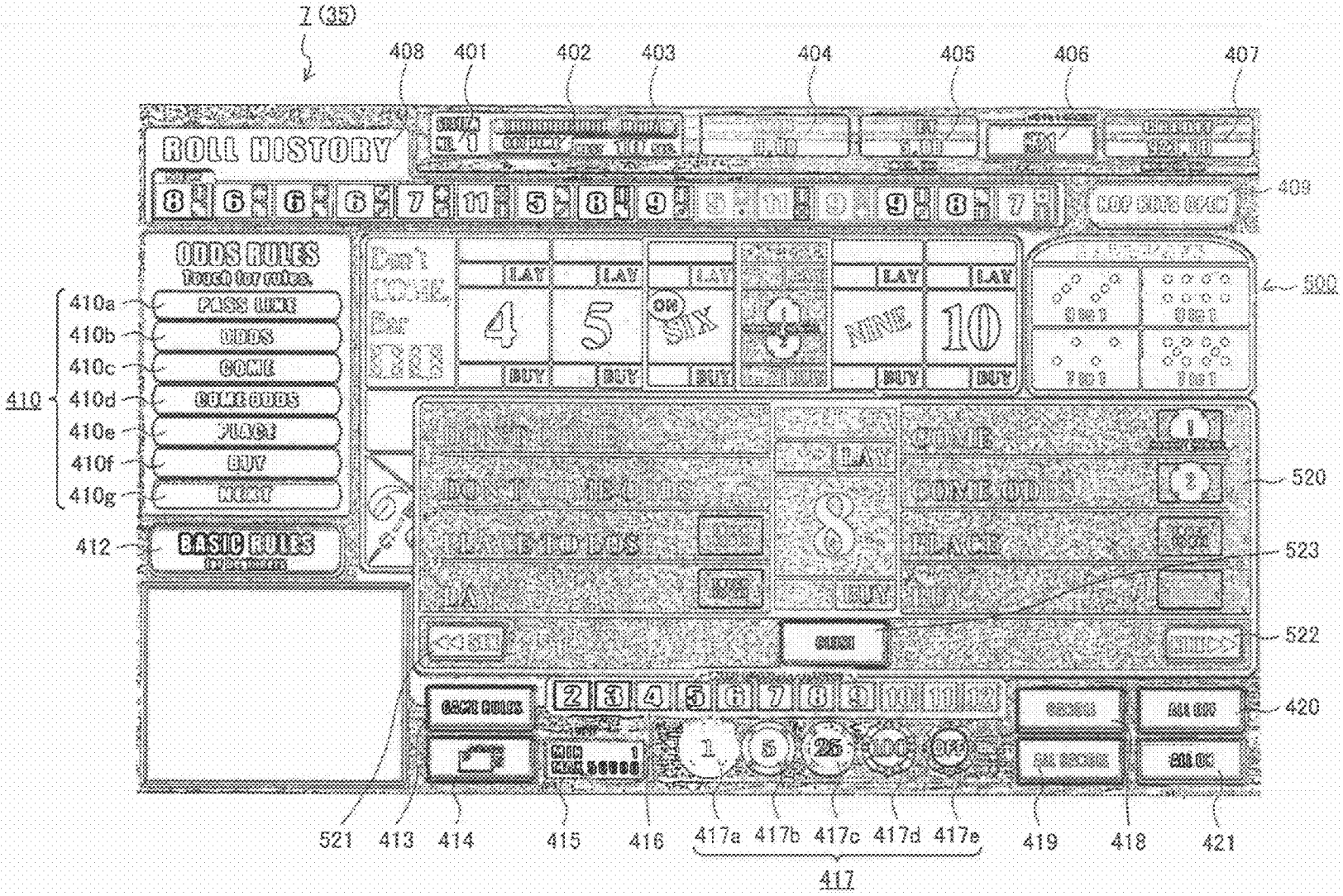
FIG. 29 is a view showing one example of the display screen according to one embodiment.

The display screen shown in FIG. 29 is a screen to be displayed when "8" is operated, among "4", "5", "SIX", "8", "NINE", and "10". The display screen shown in FIG. 29 displays a betting board extension portion 520 so as to overlap on part of the betting board 500 in the display screen shown in FIG. 14. An image similar to "8" in the betting board 500 is disposed at the center of the betting board extension portion 520; and "DON'T COME", "DON'T COME ODDS", "PLACE TO LOSE", "LAY", "COME", "COME ODDS", "PLACE", and "BUY" betting areas are disposed at the left and right of the betting board extension portion 520. Numeric value selection buttons 521, 522 and a "CLOSE" button 523 are disposed at the lower side of the betting board extension portion 520.

Figure 30:
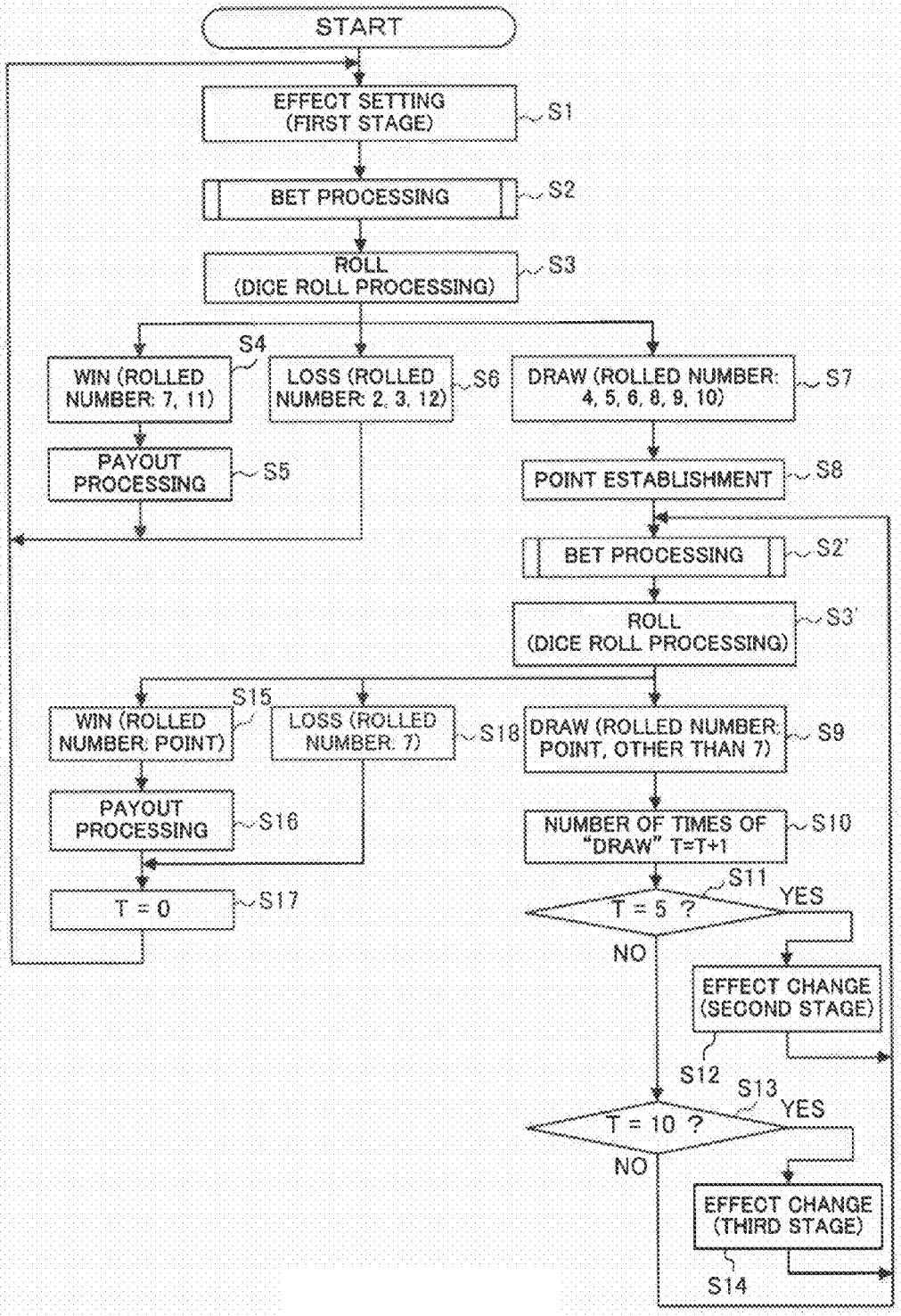
FIG. 30 is a flowchart of dice gate execution processing to be executed in the gaming machine according to one embodiment of the present invention.
Figure 32:
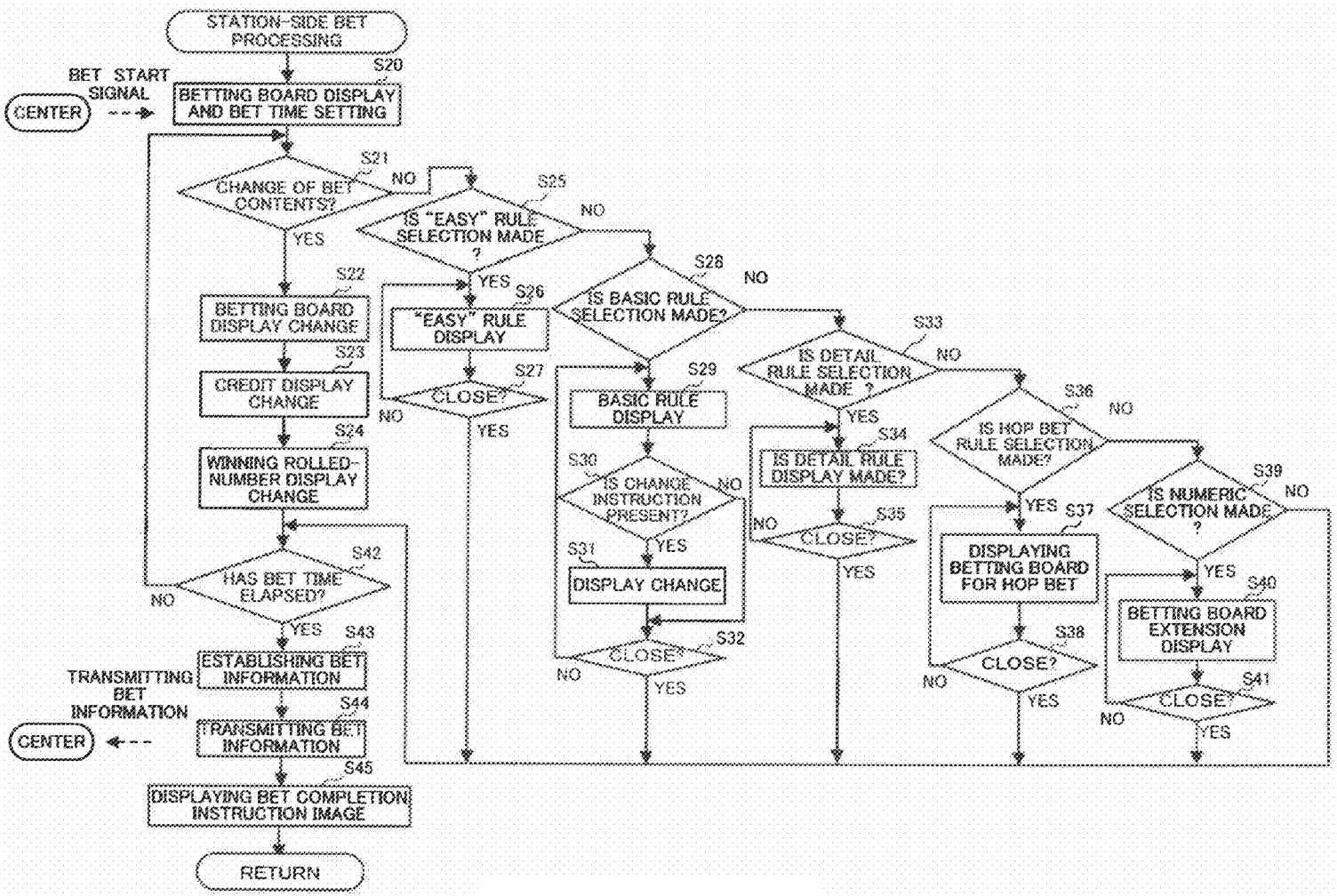
FIG. 32 is a flowchart of station-side bet processing to be executed in the game machine according to one embodiment of the present invention.

Subsequently, with reference to FIG. 30 to FIG. 32, a description will be given with respect to processing to be executed in a main control portion 80, a station control portion 110 of a gaming machine 1 according to the embodiment. FIG. 30 is a flowchart showing processing of executing a dice game whose progress is controlled by a CPU 81 of a main control portion 80. In FIG. 30, the rolled numbers of a win, a loss, or a draw indicate values in a case where a bet is placed on a pass line. First, the CPU 81 refers to the effect table stored in a ROM 82 to select an effect corresponding to the number of times of "draw" of rolls stored in a RAM 83 and then execute the effect (step S1). In step S1, since the number of times of rolls stored in the RAM 83 is 0, the effect at a first stage is set.

Next, CPU 81 conducts bet processing. Hereinafter, a description of the bet processing will be given. FIG. 31 is a flowchart of a center-side bet processing to be executed in a gaming machine 1.

In step S51, the CPU 81 sets bet time (60 seconds, for example) and then transmits a bet start signal to each station 4. The bet start signal is a signal for transmitting bet start and bet time to each station 4.

In step S52, the CPU 81 conducts control to display a bet start instruction image on an image display device 225 and a display screen 210*a* of a dealer's display 210 and to notify to a dealer and each player that betting is started. Whether or not to display a bet start instruction image may be determined according to a dealer's level, referring to an instruction image display determination table (see FIG. 17). In this manner, it becomes possible to determine whether or not to display a bet start instruction image on the display screen 210*a* of the dealer's display 210 in accordance with the dealer's level.

In step S53, the CPU 81 conducts processing of receiving bet information from station 4. Specifically, the CPU 81 conducts control to receive bet information from a respective one of a plurality of touch panels 35 included in a respective one of a plurality of stations 4. In addition, the CPU 81 conducts control to update a bet presence or absence determination table (see FIG. 18) for each station 4 having received bet information.

In step S54, the CPU 81 determines whether or not bet information is received from all stations 4, based upon the bet presence or absence determination table. If the CPU 81 determines that bet information is received from all stations (step S54, YES), the CPU 81 causes the routine to proceed to step S55. If the CPU 81 determines that bet information is not received all stations (step S54, NO), the CPU 81 causes the routine to revert to step S53. In step S55, the CPU 81 displays a bet completion instruction image on the image display device 225 and the display screen 210*a* of the dealer's display 210. Whether or not to display the bet completion instruction image may be determined according to the dealer's level, referring to an instruction image display table (see FIG. 17). Afterwards, this subroutine is completed and then is reverted to the routine shown in FIG. 30.

Next, a subroutine to be executed at a station 4 in correspondence with the subroutine shown in FIG. 31 will be described. FIG. 32 is a flowchart of a station-side bet processing to be executed in a gaming machine 1.

The CPU 111 conducts processing of receiving a bet start signal transmitted from the CPU 81 of the main control portion 80; displaying on an image display device 7 a display screen (see FIG. 14) including a betting board 500; and setting in a predetermined region of a RAM 83 a predetermined bet time (60 seconds, for example) to be compared with an elapsed time t of a timer 130 (step S20).

Next, the CPU 111 determines whether or not an instruction for changing the contents of a bet is inputted via a touch panel 35 (step S21). Where the CPU 111 determines that the instruction for changing the contents of the bet is inputted (step S21, YES), the CPU 111 changes display of a betting board 500. Specifically, the CPU 111 places chips in a betting area of the betting board 500, for example. Next, the CPU 111 changes a credit display, based upon the contents of a bet (step S23). Further, the CPU 111 changes display of rolled numbers in a winning rolled-number information display portion 416, based upon the contents of a bet (step S24). The rolled numbers, a display mode of which is to be changed in the winning rolled-number display portion 416, are those which a player can win based upon the contents of a bet on a current betting board. Afterwards, the CPU 111 causes the routine to revert to step S42.

Where the CPU 111 determines that an instruction for changing the contents of a bet is not inputted in step S21 (step S21, NO), the CPU 111 determines whether or not an instruction for selecting an "easy" rule, i.e., whether or not an instruction for selecting any one of bet type selection buttons 410 is inputted via the touch panel 35 (step S25). Where the CPU 111 determines that an instruction for selecting any one of the bet type selection buttons 410 is inputted, the CPU 111 displays an "easy" rule (step S26). That is, a bet type information display portion 411 is displayed (see FIG. 1). Here, the display of the bet type information display portion 411 will be described. In step S25, if a player touches a region of the touch panel 35 corresponding to the bet type selection button 410*a*, the bet type information display portion 411 is displayed so as to overlap on part of the betting board 500. At this time, as shown in FIG. 1, the bet type information display portion 411 showing a description of "PASS LINE" is displayed so as not to overlap on a betting area "PASS LINE" in the betting board 500. Therefore, a player can place a bet on the betting area "PASS LINE" with the bet type information display portion 411 being displayed indicating a description of "PASS LINE".

That is, a program ROM included in a liquid crystal drive circuit 120 stores a display position coordinate of a betting board, a display position coordinate of each betting area, and a display position coordinate of the bet type information display portion 411. The display position coordinate of the bet type information display portion 411 is set so that: the bet type information display portion 411 is positioned on the betting board 500; and the bet type information display portion 411 and a betting area associated with a bet type of the bet type information display portion 411 do not overlap.

It is desirable that a gaming machine of the present invention, as described above, comprises a display device, an input device, a memory, and a processor, the memory storing: layout data indicating a betting board including a plurality of betting areas; and information data indicating information for description of the bet type according to each of a plurality of bet types, each of the plurality of betting areas being associated with any of a plurality of bet types, the processor being programmed to execute processing of: (A) displaying a betting board on a display device, based upon layout data stored in a memory; and (B) when a betting board is displayed on the display device, where an instruction for selecting any of a plurality of bet types is inputted, displaying information for description of the bet type in a region in which a betting area associated with the bet type on the betting board is not disposed. With a betting area being verified in a betting board, a description of a bet type with which the betting area is associated can be read, which is excellent in convenience and enables even a beginner to smoothly participate in a game.

Further, in the above-described configuration, it is desirable that a processor is configured to accept a bet on a betting area when both of information for description of bet types and the betting area associated with the bet type on a betting board are displayed, in the processing of (B). A player can place a bet on a betting area while reading a description of a bet type with which a betting area is associated, which is further excellent in convenience.

Subsequent to step S26, the CPU 111 determines whether or not to close a bet type information display portion 411 (step S27). As a timing of closing the bet type information display portion 411, for example, there can be exemplified a time point at which a predetermined time has elapsed after display of the bet type information display portion 411 has been started. Where the CPU 111 determines that the timing of closing the bet type information display portion 411 is not reached (step S27, NO), the CPU 111 causes the routine to revert to step S26. Where the CPU 111 determines that the timing of closing is reached (step S27, YES), the CPU 111 completes display and causes the routine to revert to step S42.

Where the CPU 111 determines that an "easy" rule is selected in step S25 (step S25, NO), the CPU 111 determines whether or not an input for selecting a basic rule occurs, i.e., whether or not a game rule display button 412 is operated via the touch panel 35 (step S28). Where the CPU 111 determines that an input for selecting a basic rule occurs in step S28, the CPU 111 displays the basic rule, i.e., displays a game rule information display portion 501 (see FIG. 25) (step S29).

Next, the CPU 111 determines whether or not an instruction for changing display of a basic rule is inputted via the touch panel 35, i.e., whether or not a "RULES" button 501*a*, a "SHOOTER" button 502*a*, or an "OTHER BETS" button 503*a* are operated via the touch panel 35 (step S30).

The "RULES" button 501*a* is associated with a game rule information display portion 501; the "SHOOTER" button 502*a* is associated with a game rule information display portion 502; and an "OTHER BETS" button 503*a* is associated with a game rule information display portion 503. Where the CPU 111 determines that an instruction for changing display of a basic rule is inputted (step S30, YES), the CPU 111 changes to display of a game rule information display portion associated with an operated button, among buttons 501*a* to 503*a* (step S31). Where the CPU determines whether the instruction for changing display of the basic rule is not changed (step S30, NO), the CPU 111 causes the routine to revert to step S32.

Next, the CPU 111 determines whether or not a "CLOSE" button 504 is operated (step S32). Where the CPU 111 determines whether the "CLOSE" button 504 is not operated (step S32, NO), the CPU 111 causes the routine to revert to step S29. Where the CPU 111 determines that the "CLOSE" button 504 is operated (step S32, YES), the CPU 111 completes display of a game rule display portion and then causes the routine to migrate to step S42.

Where the CPU 111 determines that a basic rule is not selected in step S28 (step S28, YES), the CPU 111 determines whether or not an input for selecting a detail rule occurs, i.e., whether or not a bet rule display button 413 is operated via the touch panel 35 (step S33).

Where the CPU 111 determines that an input for selecting a detail rule occurs (step S33, YES), the CPU 111 displays an image indicating a detailed description of each bet type (step S34). In the embodiment, although the detail rule is not shown, an image indicating a detail rule is displayed so as to cover the entirety of the betting board 500. While, in the present invention, an image indicating a detail rule is displayed for each bet type as in the "easy" rule, there may be eliminated a need to cover a betting area corresponding to the bet type. Next, the CPU 111 determines whether or not the "CLOSE" button disposed in an image indicating a detail rule is operated (step S35). Where the CPU 111 determines that the CLOSE" button is not operated (step S35, NO), the CPU 111 causes the routine to revert to step S34. Where the CPU 111 determines that the "CLOSE" button is operated (step S35, YES), the CPU 111 causes the routine to revert to step S42.

Where the CPU 111 determines that an instruction for displaying a detail rule in step S33 is not inputted (step S33, NO), the CPU 111 determines whether or not an instruction for selecting HOP BET is inputted, i.e., whether or not a hop bet extension button 409 is operated via the touch panel 35 (step S36).

Where the CPU 111 determines that an instruction for selecting HOP BET is inputted, the CPU 111 displays a betting board 510 for hop bet (see FIG. 28) so as to overlap on a betting board 500 (step S37).

Next, the CPU 111 determines whether or not the "CLOSE" button 504 is operated (step S38). Where the CPU 111 determines that the "CLOSE" button 511 is not operated (step S38, NO), the CPU 111 causes the routine to revert to step S37. Where the CPU 111 determines that the "CLOSE" button 511 is operated (step S38, YES), the CPU 111 completes display of the betting board 510 for hop bet and then causes the routine to proceed to step S42.

Where the CPU 111 determines an instruction for selecting HOP BET is not inputted in step S36 (step S36, NO), the CPU 111 determines whether or not an instruction for selecting any of numbers ("4", "5", "SIX", "8", "NINE", and "10") in the betting board 500 is inputted (step S39).

Where the CPU 111 determines that an instruction for selecting a number in step S39 is inputted (step S39, YES), the CPU 111 displays a betting board extension portion 520 on the betting board 500 in an overlapped manner (step S40).

At this time, as shown in FIG. 29, the betting board extension portion 520 is displayed so as not to overlap on numbers ("4", "5", "SIX", "8", "NINE" and "10") within the betting board 500.

That is, the program ROM included in a liquid crystal drive circuit 120 stores: a display position coordinate of a betting board; a display position coordinate of each betting area; and a display position coordinate of a betting board extension portion 520. In the display position coordinate of the betting board extension portion 520, the betting board extension portion 520 is positioned on the betting board 500 and is set so that the betting board extension portion 520 and the numbers ("4", "5", "SIX", "8", "NINE", and "10") in the betting board extension portion 520 do not overlap on each other.

Next, the CPU 111 determines whether or not the "CLOSE" button 523 is operated (step S41). Where the CPU 411 determines whether the "CLOSE" button 523 is not operated (step S41, NO), the CPU 111 causes the routine to revert to step S40. Where the CPU 111 determines that the "CLOSE" button 523 is operated (step S41, YES), the CPU 111 completes display of the betting board extension portion 520 and then causes the routine to migrate to step S42.

In step S42, the CPU 111 determines whether or not bet time has elapsed. That is, the CPU 111 compares an elapsed time t of the timer 130 with bet time set in a predetermined region of the RAM 113 and then determines whether or not the elapsed time t of the timer 130 is on or beyond the bet time set in the predetermined region of the RAM 113.

Where the CPU 111 determines that the bet time has not elapsed, the CPU 111 causes the routine to revert to step S21. Where the CPU 111 determines that the bet time has elapsed, the CPU 111 establishes bet information including information associated with a bet amount and a betted betting area (step S43) and then transits the bet information to the CPU 81 (step S44). Even if a bet is not placed at a station 4 at all, the CPU 111 transmits bet information.

Next, the CPU 111 displays on the image display device 7 a bet completion instruction image indicating that bet time has elapsed (step S45) and then completes this subroutine. Afterwards, the CPU 111 causes the routine to revert to the routine shown in FIG. 30.

As described above, when step 1 and step 2 shown in FIG. 30 are conducted, roll (dice roll processing) is then conducted (step S3). In step S3, the CPU 111 first refers to a vibration mode data table (see FIG. 19) to randomly extract vibration pattern data. Based upon the extracted vibration pattern data, the CPU 111 refers to an effect table (see FIG. 20) to extract effect data corresponding to a vibration mode. Then, based upon the effect data corresponding to the vibration mode, a gaming board 3*a* is vibrated by controlling a vibration motor 300. Further, an effect due to sound and/or light is provided based upon effect data corresponding to the vibration mode. In step S3, in processing of determining rolled numbers or the like of dice in a dice game, the CPU 111 and subsequently the CPU 81 determine whether or not two items of identification data, identification data 1 and 2 exist in an IC tag data table (see FIG. 21) received from an IC tag reader 16. Where it is determined that these two items of identification data exist, items of identification data 1 and 2 are analyzed and then rolled numbers of the two dice are determined. Where it is determined that two items of identification data 1 and 2 exist, the items of identification data 1 and 2 are analyzed and then rolled numbers of the two dice are determined. Where it is determined that the two items of identification data exist, infrared-ray camera image pickup data is received as to a respective one of dice 70*a*, 70*b* from an infrared-ray camera 15. The positions of the dice on the gaming board 3*a* are then determined based upon an infrared-ray camera image pickup data table (see FIG. 22). Based upon the infrared-ray camera image pickup table (see FIG. 22) and a type dot pattern data table (see FIG. 23), type (color) of the dice is determined. Based upon the infrared-ray camera image pickup data table (see FIG. 22) and a rolled-number pattern data table (see FIG. 24), rolled numbers of the dice are determined.

Next, where rolled numbers are "7" or "11", it follows a win (step S4); payout processing according to a bet amount is conducted (step S5); and the routine is reverted to step S1. Where rolled numbers are "2", "3", or "12", it follows a loss (step S6) and the routine is reverted to step S1. Where rolled numbers are "4", "5", "6", "8", "9", or "10", it follows a draw (step S7). In this case, rolled numbers are established as a "point", these rolled numbers are stored in the RAM 83 and then a display region of a betting board 500 corresponding to this "point" is highlighted (step S8). Next, bet processing (step S2') and roll (step S3') are conducted. The processing of step S2' and step S3' is similar to that of step S2 and step S3 which have already been described. Therefore, a duplicate description is omitted here. Next, the rolled numbers are those other than a number corresponding to "point" and a number "7", it follows a draw (step S9). Afterwards, the CPU 81 increments the number of draws T (T=T+1) and then stores the incremented number in a predetermined region of the RAM 83 (step S10).

Next, the CPU 81 determines whether or not the number of times of "draw" T stored in the RAM 83 is T=5 (step S11. Where T=5 (step S11, YES), the CPU 81 refers to the effect table stored in the ROM 82 to select an effect corresponding to the number of times of "draw" T stored in the RAM 83 and then execute the effect (step S12). In this manner, the effect of the first stage can be changed to that of the second stage. Afterwards, the routine is reverted to step S2'.

If T=5 is not established (step S11, NO), the CPU 81 determines whether or not the number of times of "draw" stored in the RAM 83 is T=10 (step S13). Where T=10 (step S13, YES), the CPU 81 refers to the effect table stored in the ROM 82 to select the effect corresponding to the number of times of "draw" on rolls stored in the RAM 83 and then execute the effect (step S14). Afterwards, the routine is reverted to step S2'. If T=10 is not established (step S13, NO), the routine is reverted to step S2'.

In step S3', where rolled numbers are established as a "point", it follows a win (step S15), payout processing according to a bet amount is conducted (step S16). The number of times of "draw" is reset to T=0 (step S17) and then the routine is reverted to step S1. In step S3', where rolled numbers are "7", it follows a loss (step S18), the number of times of "draw" T is reset to T=0 (step S17) and then the routine is reverted to step S1.

Hereinbefore, the present embodiments have been described. While the embodiments described a case in which two dice 70 are employed, the number of dice in the present invention is not limitative thereto, and five dice may be employed, for example.

While the embodiments described a dice game such as SICBO, the present invention is applicable to roulette games or card games such as baccarat without being limitative thereto.

While the embodiments described a case in which a controller in the present invention is comprised of: a CPU 81 included in a main control portion 80; and a CPU 111 included in a station 4, the controller in the present invention may be comprised of only one CPU.

While the embodiments of the present invention have been described hereinbefore, these embodiments are merely illustrated as specific examples and are not meant to limit the present invention in particular. Specific features such as means can be changed in design as required. Advantageous effect(s) described in the embodiment(s) of the present invention merely enumerate the most preferable effects which are derivative from the present invention. The advantageous effect(s) due to the present invention are not limitative to those described in the embodiment(s) of the present invention.

What is claimed is:

1. A gaming machine for executing craps, comprising: a display device; an input device; a memory; and a processor, wherein the memory stores betting image data to display a betting image for receiving one or more bets with respect to a plurality of bet types, description button image data to display description buttons for receiving requests for displaying respective descriptions of the bet types, description information data to display respective descriptions of the bet types, and numeral data to display images of eleven numerals consisting of 2 to 12;

wherein the input device is disposed at a front surface of the display device and comprises a position input device detecting a touched position by a player and outputting a detection signal representing the touched position; and wherein the processor is programmed to execute processing of:

(A) along with displaying the betting image that comprises abbreviations of the bet types on a first region of the display device, based upon the betting image data stored in the memory, displaying the description buttons respectively corresponding to one of the bet types on the display device based upon the description button image data stored in the memory and the images of eleven numerals consisting of 2 to 12 on the display based upon the numeral data stored in the memory;

(B) after receiving a detection signal, from the position input device, representing a touched position corresponding to one of the abbreviations of the bet types comprised in the betting image displayed in (A), deciding a casting result of two dices and awarding a win to the player according to the casting result of two dices and the bet type corresponding to the touched position;

and (C) in a case where a detection signal representing a touched position corresponding to one of the description buttons displayed in (A) is received from the position input device, displaying the description of the bet types corresponding to the touched position on the display device based upon the description information data stored in the memory;

(D) in a case where a detection signal representing a touched position corresponding to one of the abbreviations of the bet types comprised in the betting image displayed in (A) is received from the position input device, changing image mode of at least one of the images of the eleven numerals, which is(or are) corresponding to a sum of casting result of two dices to win in the bet type corresponding to the touched position, wherein, in (D), in a case where a detection signal representing a touched position corresponding to HARDWAYS of 4 is received from the position input device, an image of HARD is displayed on the image of 8, which is corresponding to the sum of casting result of two dices to win in HARDWAYS of 4.

2. The gaming machine according to claim 1, wherein, in (A), the description buttons are displayed on a second region of the display device, which is different from and does not overlap with the first region, and wherein, in (B), the description of the bet types are displayed on a third region of the display device, which is different from and does not overlap with the first region and the second region.

3. The gaming machine according to claim 1, wherein the gaming machine is a gaming machine has an effect device; the memory stores plural types of effect data for providing an effect by the effect device; each of the plurality of effect data is associated with a number of draws; the processor is programmed to execute processing of: (E) counting the number of draws; and (F) providing an effect by the effect device corresponding to the counted number of draws, based upon the effect data.

* * * * *